US008142971B2

(12) United States Patent
Mizutani et al.

(10) Patent No.: US 8,142,971 B2
(45) Date of Patent: Mar. 27, 2012

(54) ELECTROSTATIC CHARGE DEVELOPER, ELECTROSTATIC CHARGE IMAGE DEVELOPER CARTRIDGE, PROCESS CARTRIDGE, AND IMAGE FORMING APPARATUS

(75) Inventors: Noriyuki Mizutani, Kanagawa (JP); Yasuhiro Arima, Kanagawa (JP); Fusako Kiyono, Kanagawa (JP); Susumu Yoshino, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 670 days.

(21) Appl. No.: 12/251,156

(22) Filed: Oct. 14, 2008

(65) Prior Publication Data

US 2009/0245858 A1 Oct. 1, 2009

(30) Foreign Application Priority Data

Mar. 25, 2008 (JP) ..... 2008-077993

(51) Int. Cl.
*G03G 9/113* (2006.01)

(52) U.S. Cl. ..... 430/109.4; 430/111.35

(58) Field of Classification Search ..... 430/109.4, 430/111.35

See application file for complete search history.

(56) References Cited

U.S. PATENT DOCUMENTS

| | | | | |
|---|---|---|---|---|
| 2003/0129518 | A1* | 7/2003 | Sawada et al. | 430/109.4 |
| 2005/0250037 | A1* | 11/2005 | Sawada et al. | 430/109.4 |
| 2006/0216628 | A1 | 9/2006 | Nakamura et al. | |
| 2006/0292477 | A1* | 12/2006 | Daimon et al. | 430/109.4 |
| 2007/0092821 | A1* | 4/2007 | Sato et al. | 430/108.4 |
| 2008/0056769 | A1* | 3/2008 | Iizuka et al. | 399/252 |

FOREIGN PATENT DOCUMENTS

| | | |
|---|---|---|
| JP | B2-62-39428 | 8/1987 |
| JP | A-2004-226847 | 8/2004 |
| JP | A-2006-267231 | 10/2006 |

* cited by examiner

*Primary Examiner* — Hoa Le

(74) *Attorney, Agent, or Firm* — Oliff & Berridge, PLC

(57) ABSTRACT

An electrostatic charge developer includes a carrier having a core material and a resin coating layer covering the surface of the core material, and a toner having a binder resin that contains a non-crystalline polyester resin and a crystalline polyester resin. The resin coating layer contains a copolymer that contains a nitrogen-containing acrylic ester or nitrogen-containing methacrylic ester and an alicyclic acrylic ester or alicyclic methacrylic ester. The non-crystalline polyester resin contains at least an alkyl succinic acid or an anhydride or lower alkyl ester thereof, or an alkenyl succinic acid or an anhydride or lower alkyl ester thereof. The crystalline polyester resin is an aliphatic polyester resin.

13 Claims, 2 Drawing Sheets

ELECTROSTATIC CHARGE DEVELOPER, ELECTROSTATIC CHARGE IMAGE DEVELOPER CARTRIDGE, PROCESS CARTRIDGE, AND IMAGE FORMING APPARATUS

CROSS-REFERENCE TO RELATED APPLICATION

This application is based on and claims priority under 35 USC 119 from Japanese patent Application No. 2008-077993 filed on Mar. 25, 2008.

BACKGROUND

1. Technical Field

The present invention relates to an electrostatic charge developer, an electrostatic charge image developer cartridge, a process cartridge, and an image forming apparatus.

2. Related Art

In recent years, with growing demand for reducing energy required in image forming processes, needs for a technology of lowering the fixing temperature of toner have arisen in order to reduce the electric power consumption in the fixing process, which occupies a large proportion of electric power consumption, and in order to achieve a higher processing speed and a higher productivity.

As a means for lowering the fixing temperature of toner, a technology of lowering the glass transition temperature of a toner resin (binder resin) has been generally employed.

SUMMARY

According to an aspect of the invention, there is provided an electrostatic charge developer including:

a carrier having a core material and a resin coating layer covering a surface of the core material, the resin coating layer containing a copolymer that contains (i) a nitrogen-containing acrylic ester or a nitrogen-containing methacrylic ester and (ii) an alicyclic acrylic ester or alicyclic methacrylic ester; and a toner containing a binder resin that contains a non-crystalline polyester resin and a crystalline polyester resin, the non-crystalline polyester resin containing at least (i) an alkyl succinic acid or an anhydride or lower alkyl ester thereof or (ii) an alkenyl succinic acid or an anhydride or lower alkyl ester thereof, and the crystalline polyester resin being an aliphatic polyester resin.

BRIEF DESCRIPTION OF THE DRAWINGS

Exemplary embodiments of the present invention will be described in detail based on the following figures, wherein.

DETAILED DESCRIPTION

Figure 1:
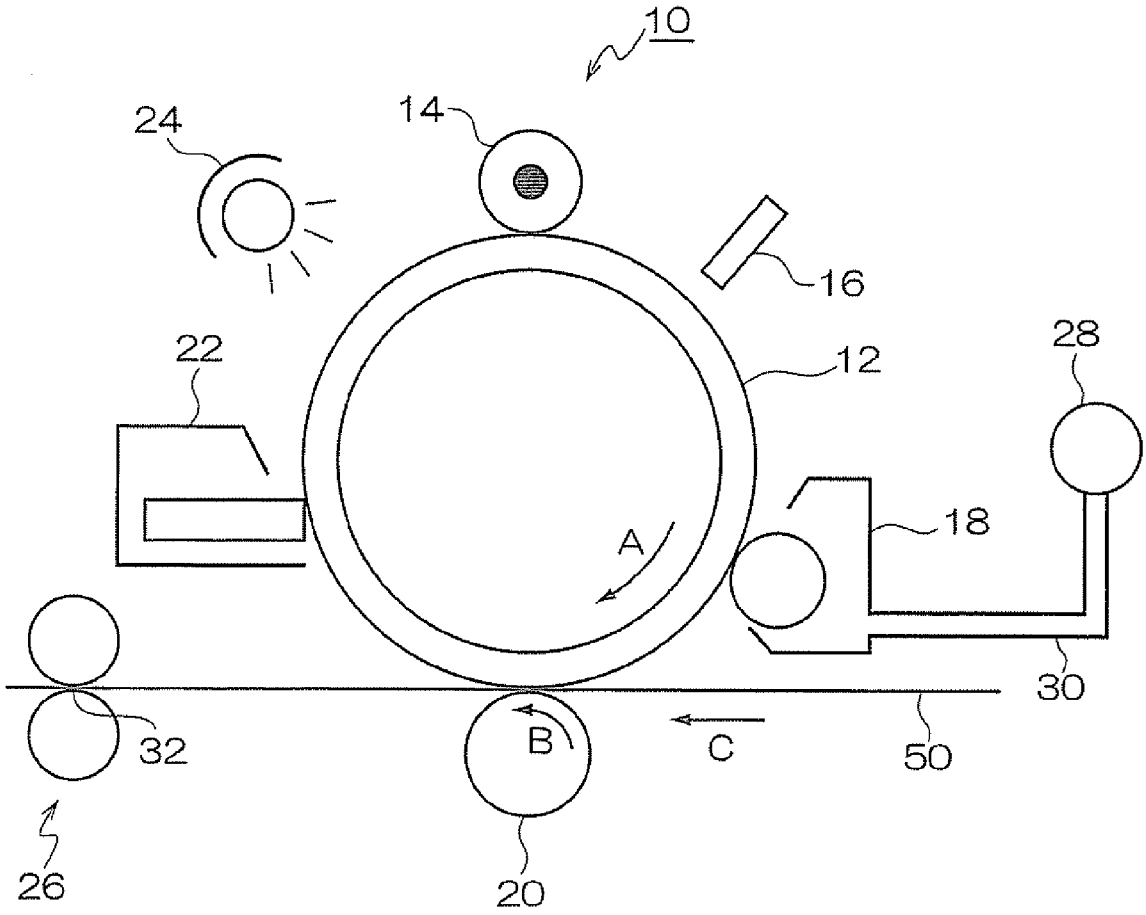
FIG. 1 is a schematic diagram illustrating an example of an image forming apparatus according to an exemplary embodiment of the present invention.

Hereinafter, an exemplary embodiment of the present invention will be described in detail.

Electrostatic Charge Developer

An electrostatic charge developer (hereinafter, simply abbreviated as "developer" in some cases) according to an exemplary embodiment of the present invention includes a carrier (hereinafter, simply abbreviated as "specific carrier" in some cases) having a core material and a resin coating layer covering the surface of the core material and a toner (hereinafter, simply abbreviated as "specific toner" in some cases) containing a binder resin. The resin coating layer contains a copolymer, and the copolymer contains a nitrogen-containing acrylic ester or a nitrogen-containing methacrylic ester, and an alicyclic acrylic ester or an alicyclic methacrylic ester. The binder resin in the toner contains a non-crystalline polyester resin and a crystalline polyester resin. The non-crystalline polyester resin contains an alkyl succinic acid or an acid anhydride or lower alkyl ester thereof, or an alkenyl succinic acid or an acid anhydride or lower alkyl ester thereof. The crystalline polyester resin is an aliphatic polyester resin.

The term "(meth)acryl" as used herein refers to either "acryl" or "methacryl" or both.

In the specific carrier, the content of the nitrogen-containing (meth)acrylic ester in the copolymer contained in the resin coating layer is preferably from 0.2 mol % to 5.0 mol % (or about 0.2 mol % to about 5.0 mol %), more preferably from 0.3 mol % to 2.5 mol %, and still more preferably from 0.3 mol % to 1.5 mol %. When the content of the nitrogen-containing (meth)acrylic ester is less than 0.2 mol %, adhesion may be insufficient and the resin coating layer of the carrier may be likely to be peeled off. Further, when used over a long time, the charge imparting ability may be lowered. On the other hand, when the content of the nitrogen-containing, (meth)acrylic ester is larger than 5.0 mol %, the difference in charging amount between a high temperature and high humidity environment and a low temperature and low humidity environment may be large.

The content of the alicyclic (meth)acrylic ester in the resin coating layer is preferably from 85.0 mol % to 99.8 mol % (or from about 85.0 mol % to about 99.8 mol %), more preferably from 90 mol % to 99.8 mol %, and more preferably from 92 mol % to 99.5 mol %. When the content of the alicyclic (meth)acrylic ester is less than 85 mol %, the affinity between the resin coating layer of the carrier and the crystalline polyester resin may be insufficient, the ability to capture the crystalline polyester resin may be lowered, and toner sticking may occur during long time use. On the other hand, when the content of the alicyclic (meth)acrylic ester is larger than 99.8 mol %, the crystallinity of the resin coating layer of the carrier is increased, the adhesion to the base material is lowered, and the resin coating layer easily peels off, so that the carrier may be unsuitable for long time use.

Specific Toner

The specific toner will be explained first.

The specific toner contains at least a binder resin and optionally contains one or more additives such as a releasing agent, a coloring agent, and inorganic particles. Each constituent component of the specific toner will be explained in detail separately.

Binder Resin

The binder resin contains at least a crystalline polyester resin and a non-crystalline polyester resin, and optionally contains one or more other resins.

Non-Crystalline Polyester Resin:

The term "non-crystalline polyester resin" as used herein refers to a polyester resin that may show, in the differential scanning calorimetry (DSC) as defined in JIS K7121-1987 (which is incorporated herein by reference), a step-wise endothermic change corresponding to glass transition (that is, a change in which a DSC curve shifts from one base line to another base line), but does not show an endothermic peak corresponding to a crystal melting temperature (that is, a chance in which a DSC curve deviates from a base line, forms an endothermic peak, and returns back to the same base line).

The non-crystalline polyester resin is synthesized from a polycarboxylic acid component and a polyhydric alcohol component. The non-crystalline polyester resin may be a single non-crystalline polyester resin or may be a mixture of two or more polyester resins.

The polycarboxylic acid used in the non-crystalline polyester resin is an alkyl succinic acid or an anhydride or lower alkyl ester thereof, or an alkenyl succinic acid or an anhydride or lower alkyl ester thereof. Further, it is possible to additionally use one or more monomer components (e.g., other polycarboxylic acids, such as known divalent or trivalent or higher-valent carboxylic acids). Further, no limitation is imposed on the polyhydric alcohol used in the non-crystalline polyester resin. For example, it is possible to use known dihydric or trihydric or higher-hydric alcohols.

Specific examples of these polymerizable monomer components include those described in the following.

Examples of other polycarboxylic acids include divalent carboxylic acids (for example, dibasic acids such as succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid, and mesaconic acid), anhydrides and lower alkyl esters thereof, and aliphatic unsaturated dicarboxylic acids such as maleic acid, fumaric acid, itaconic acid, and citraconic acid. Among these compounds, the proportion of terephthalic acid to the total acid components is preferably 30 mol % or more, in consideration of a balance between the glass transition temperature and molecular flexibility of the polyester resin.

Examples of tri- or higher-valent carboxylic acids include 1,2,4-benzene tricarboxylic acid, 1,2,5-benzene tricarboxylic acid, 1,2,4-naphthalene tricarboxylic acid, and anhydrides and lower alkyl esters thereof. The polyvalent carboxylic acid may be used singly or in combination of two or more thereof.

Examples of polyhydric alcohols include dihydric alchols (for example, bisphenol derivatives such as hydrogenated bisphenol A and ethylene oxide or propylene oxide adducts of bisphenol A, cyclic aliphatic alcohols such as 1,4-cyclohexane diol and 1,4-cyclohexane dimethanol, linear diols such as ethylene glycol, diethylene glycol, propylene glycol, dipropylene glycol, 1,4-butane diol, 1,5-pentane diol, and 1,6-hexane diol, and branched diols such as 1,2-propane diol, 1,3-butane diol, neopentyl glycol, and 2,2-diethyl-1,3-propane diol).

Considering the charging property and strength, an ethylene oxide or propylene oxide adduct of bisphenol A is suitably used.

Further, examples of tri- or higher-hydric alcohols include glycerin, trimethylol ethane, trimethylol propane, and pentaerythritol. Considering low-temperature fixing property and image gloss, the amount of tri- or higher-valent cross-linking monomers is preferably 10 mol % or less with respect to the total amount of monomers. It is possible to use one of these monomers, or, alternatively, two or more thereof.

In accordance with the necessity, one or more substances selected from a mono-valent acid such as acetic acid or benzoic acid and a mono-hydric alcohol such as cyclohexanol or benzyl alcohol may be used in order to control the acid value or the hydroxyl value.

Examples of the alkyl succinic acid, alkenyl succinic acid, and anhydrides or lower alkyl esters thereof include n-butyl succinic acid, n-butenyl succinic acid, isobutyl succinic acid, isobutenyl succinic acid, n-octyl succinic acid, n-octenyl succinic acid, n-dodecyl succinic acid, n-dodecenyl succinic acid, isododecyl succinic acid, isododecenyl succinic acid, and anhydrides and lower alkyl esters thereof.

The number of the carbon atoms in the alkyl or alkenyl group in the alkyl succinic acid, alkenyl succinic acid, and anhydrides or lower alkyl esters thereof may be larger than the number of the carbon atoms in the constituent monomer used for an aliphatic crystalline polyester resin described later, in order that the resin has the preferred properties described above. In addition, n-dodecenyl succinic acid and anhydride thereof are more preferred, in consideration of the compatibility with the aliphatic crystalline polyester resin and the easiness in controlling the glass transition temperature of the non-crystalline polyester resin.

The non-crystalline polyester resin can be synthesized from an arbitrary combination of the aforementioned monomers by using conventional known methods. For example, it is possible to use one of, or a combination of two or more of, an ester exchange reaction process, a direct polycondensation process, and the like.

Specifically, the reaction may be performed, for example at a polymerization temperature of from 140° C. to 270° C. while the water or alcohol produced by condensation is removed, optionally reducing the pressure of the reaction system. If the monomers are not dissolved or not miscible at the reaction temperature, the monomers may be dissolved by adding a high boiling temperature solvent that serves as an auxiliary solvent for dissolution. In the case of polycondensation, the reaction is carried out while the auxiliary solvent is distilled away. When a monomer having poor compatibility is involved in copolymerization, the monomer having poor compatibility may be preliminary condensed with an acid or alcohol that is to be polycondensed with the monomer, and the obtained condensate may be polycondensed with main components.

The molar ratio (acid component/alcohol component) at which the acid component and the alcohol component are reacted is not specified generally because it depends on reaction conditions and others, but is usually from 0.9/1 to 1/0.9 in the case of a direct polycondensation process, for example. In the case of an ester exchange reaction process, it is possible to use a monomer that can be distilled away under vacuum, such as ethylene glycol, propylene glycol, neopentyl glycol, or cyclohexane dimethanol, in excess.

Examples of catalysts usable for the production of the non-crystalline polyester resin include a compound of an alkali metal such as sodium or lithium; a compound of an alkaline earth metal such as magnesium or calcium; a compound of a metal such as zinc, manganese, antimony, titanium, tin, zirconium, or germanium; a phosphorous acid compound; a phosphoric acid compound; and an amine compound, specific examples of which include the following compounds.

Specific examples include sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributyl antimony, tin formate, tin oxalate, tetraphenyl tin, dibutyl tin dichloride, dibutyl tin oxide, diphenyl tin oxide, zirconium tetrabutoxide, zirconium naphthenate, zirconyl carbonate, zirconyl acetate, zirconyl stearate, zirconyl octylate, germanium oxide, triphenyl phosphite, tris(2,4-di-t-butylphenyl) phosphite, ethyl triphenylphosphonium bromide, triethyl amine, and triphenyl amine. Among these, a tin-containing catalyst is used preferably in consideration of the coloring property and reactivity of the resin.

Tin-containing catalysts may be classified into organic tin-containing catalysts and inorganic tin-containing catalysts. The organic tin-containing, catalysts are compounds having a Sn—C bond. The inorganic tin-containing catalysts are compounds having no Sn—C bond. The tin-containing catalysts include di-substituted, tri-substituted, and tetra-substituted catalysts, and the di-substituted catalysts are preferably used. In addition, the inorganic tin-containing catalysts are preferred.

Examples of the inorganic tin-containing catalysts include non-branched tin alkylcarboxylates such as tin diacetate, tin dihexanoate, tin dioctanoate, and tin distearate; branched tin alkylcarboxylates such as tin dineopentanoate and tin di(2-ethylhexanoate); tin carboxylates such as tin oxalate; dialkoxy tins such as dioctyloxy tin and distearoxy tin; tin halides such as tin chloride and tin bromide; tin oxide; and tin sulfate. In particular, tin dioctanoate, tin distearate, and tin oxide are preferred.

It is possible to use mainly the tin-containing catalyst, to which one or more other catalysts than the tin-containing catalyst are optionally added; such other catalysts may be selected from those described above.

The non-crystalline polyester resin preferably has a weight average molecular weight (Mw) of from 12,000 to 200,000. In particular, in order to obtain an image with a high gloss, it is more preferable that Mw is in the range of from 14,000 to 140,000 (or from about 14,000 to about 140,000) and the number average molecular weight Mn is in the range of from 4,000 to 20,000 (or from about 4,000 to about 20,000), and it is still more preferable that Mw is in the range of from 16,000 to 120,000 and Mn is in the range of from 5,000 to 12,000.

When the Mw and Mn are too high coloring property may be deteriorated. When the Mw and Mn are too small, post-fixing image strength may be reduced, and/or offset may occur at high temperatures.

The molecular weight distribution of the non-crystalline polyester resin may be in the range of from 2 to 15 in terms of Mw/Mn, which is an index of molecular weight distribution.

The molecular weight and molecular weight distribution of the resin can be measured by known methods, and usually by gel permeation chromatography (hereinafter, abbreviated as "GPC"). The details will be described below.

The acid value of the non-crystalline polyester resin is preferably in the range of from 5 mgKOH/g to 25 mgKOH/g (or from about 5 mgKOH/g to about 25 mgKOH/g) and more preferably from 7 mgKOH/g to 20 mgKOH/g.

The acid value measurement is performed by using the potentiometric titration method as defined in JIS K0070-1992, which is incorporated herein by reference. The acid values described hereinafter are also measured by this method.

The hydroxyl value measured in accordance with JIS K0070 may be in the range of from 5 mgKOH/g to 40 mgKOH/g.

The glass transition temperature of the non-crystalline polyester resin is preferably in the range of from 30° C. to 90° C. and more preferably from 30° C. to 80° C. Further, in consideration of the balance between the storage stability and fixing property of toner, the glass transition temperature of the non-crystalline polyester resin is still more preferably in the range of from 50° C. to 70° C. (or from about 50° C. to about 70° C.).

When the glass transition temperature is lower than the above range, the toner may be likely to cause blocking (a phenomenon in which toner particles aggregate to form an aggregated body) during storage or in a developing device. On the other hand, when the glass transition temperature is higher than the above range, the fixing temperature of toner may be elevated.

The glass transition temperature of the non-crystalline polyester resin is measured with a differential scanning calorimeter (DSC-50, manufactured by Shimadzu Corp.) in accordance with JIS 7121-1987, which is incorporated herein by reference. The details are described below.

The non-crystalline polyester resin preferably has a softening temperature of from 80° C. to 130° C. and more preferably from 90° C. to 120° C. When the softening temperature is lower than 80° C., the toner after fixing and during storage may be deteriorated and image stability of the toner may be worsened. On the other hand, when the softening temperature of the non-crystalline polyester resin is higher than 130° C., low-temperature fixing property may be worsened.

Further, when a temperature at which the loss elastic modulus G" (as measured at a frequency of 1 rad/s and a strain of 20% or less) of the non-crystalline polyester resin becomes 10,000 Pa is represented by Tm, Tm is preferably in the range of from 80° C. to 150° C. and more preferably from 70° C. to 120° C.

When Tm is lower than the above range, the toner may be likely to cause blocking (a phenomenon in which toner particles aggregate to form an aggregated body) during storage or in a developing device. On the other hand, when Tm is higher than the above range, the fixing temperature of the toner may be elevated.

The content of the non-crystalline polyester resin in the binder resin is not particularly limited, but is preferably in the range of from 80% to 98% by weight and more preferably from 86% to 98% by weight with respect to the whole binder resin. When the content is lower than 80% by weight, the toner strength may be lowered or the environmental stability of the charging may be worsened. When the content is larger than 98% by weight, satisfactory low-temperature fixing property may not be obtained.

Furthermore, it is preferred that the non-crystalline polyester resin is composed of a non-linear polyester resin that contains at least one of a tri- or higher-valent carboxylic acid, an anhydride thereof, or a tri- or higher-hydric alcohol, and a linear polyester resin that does no contain any of a tri- or higher-valent carboxylic acid, an anhydride thereof, or a tri- or higher-hydric alcohol.

Crystalline Polyester Resin:

The crystalline polyester resin is an aliphatic polyester resin and is used as a binder resin for toner so as to enhance the gloss and stability of an image and low-temperature fixing property. The crystalline polyester resin may be synthesized from a divalent acid (dicarboxylic acid) component and a dihydric alcohol (diol) component, and shows a definite endothermic peak (that is, a change in which a DSC curve deviates from a base line, forms an endothermic peak, and returns back to the same base line) but does not show a step-wise endothermic change (that is, a change in which a DSC curve shifts from one base line to another base line) in the differential scanning calorimetry (DSC) as defined in JIS K7121-1987. A polymer obtained by incorporating other additional copolymerization components into the main chain of the crystalline polyester resin is also within the scope of the crystalline polyester resin if the proportion of such additional components is 50% by weight or less.

In the crystalline polyester resin, the acid from which the acid-derived component derives may be selected from various dicarboxylic acids. The dicarboxylic acid from which the acid-derived component derives is not necessarily include only one dicarboxylic acid, and the crystalline polyester resin may include two or more components derived from different dicarboxylic acids. Further, in order to improve emulsifiability in the emulsification flocculation process, the dicarboxylic acid may have a sulfonic acid group in some cases.

The aforementioned "acid-derived component" indicates a constituent portion that was originally an acid component before the synthesis of the polyester resin. The "alcohol-derived component" described below indicates a constituent portion that was originally an alcohol component before the synthesis of the polyester resin.

As the dicarboxylic acid, an aliphatic dicarboxylic acid, particularly a straight chain carboxylic acid, is preferred. Examples of the straight chain carboxylic acid include oxalic acid, malonic acid, succinic acid, glutaric acid, adipic acid, pimelic acid, suberic acid, azelic acid, sebacic acid, 1,9-nonanedioic acid, 1,10-decanedioic acid, 1,11-undecanedioic acid, 1,12-dodecanedioic acid, 1,13-tridecanedioic acid, 1,14-tetradecanedioic acid, 1,18-octadecanedioic acid, 1,20-eicosandioic acid, and lower alkyl esters and acid anhydrides thereof.

As the dicarboxylic acid, among those mentioned above, a dicarboxylic acid having from 10 to 12 carbon atoms is preferred in consideration of the crystal melting temperature and the charging property. In order to enhance crystallinity, the proportion of these straight chain dicarboxylic acids to the total acid-derived components is preferably 95 mol % or more and more preferably 98 mol % or more.

The acid-derived component may further include, besides the component derived from an aliphatic dicarboxylic acid, a component derived from a dicarboxylic acid having a sulfonic acid group. The dicarboxylic acid having a sulfonic acid group is effective in that it enables a color material such as pigment to be dispersed adequately. Further, when toner particles are produced by emulsifying or suspending the whole resin in water, the presence of a sulfonic acid group enables emulsification or suspension to be carried out without using a surfactant as described below.

Examples of the dicarboxylic acid having a sulfonic acid group include, but are not limited to, sodium 2-sulfoterephthalate, sodium 5-sulfoisophthalate, and sodium sulfosuccinate, as well as lower alkyl esters and acid anhydrides thereof. Along these, sodium 5-sulfoisophthalate or the like is preferred in terms of productivity.

The content of the dicarboxylic acid having a sulfonic acid group is preferably 2.0 constituent mol % or less, and more preferably 1.0 constituent mol % or less, with respect to the whole resin. When the content of the dicarboxylic acid having a sulfonic acid group is large, charging property may be deteriorated. The aforementioned "constituent mol %" refers to the percentage, in terms of mole number, of a particular component relative to the total mole number of the components of the same class (either acid-derived components or alcohol-derived components) as that of the particular component in the polyester resin.

In the crystalline polyester resin, the alcohol from which the alcohol-derived component derives may be an aliphatic diol, and examples thereof include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol, and 1,20-eicosanediol. Among these, a diol having from 2 to 10 carbon atoms is preferred in consideration of the crystal melting temperature and the charging property. In order to enhance crystallinity, the proportion of these straight chain diols to the total alcohol-derived components may be 95 mol % or more and is preferably 98 mo % or more.

Examples of other dihydric alcohols include bisphenol A, hydrogenated bisphenol A, ethylene oxide and/or propylene oxide adduct of bisphenol A, 1,4-cyclohexane diol, 1,4-cyclohexane dimethanol, diethylene glycol, propylene glycol, dipropylene glycol, 1,3-butane diol, and neopentyl glycol. It is possible to use one of these alcohols, or, alternatively, two or more of these alcohols may be used in combination.

The crystalline polyester resin may be a crystalline polyester resin that is obtained by reacting a dicarboxylic acid having from 10 to 12 carbon atoms and a diol having from 4 to 9 carbon atoms.

If necessary, the following substances, for example, may be used in order to control the acid value or the hydroxyl value: a monovalent acid such as acetic acid or benzoic acid; a mono-hydric alcohol such as cyclohexanol or benzyl alcohol; benzene tricarboxylic acid; naphthalene tricarboxylic acid; and anhydrides and lower alkyl esters thereof; and a trihydric alcohol such as glycerin, trimethylol ethane, trimethylol propane, or pentaerythritol.

Other monomers in the crystalline polyester resin are not particularly limited, and examples thereof include divalent carboxylic acids and dihydric alcohols known so far (e.g., the monomer components described in "KOBUNSHI DATA HANDBOOK: KISOHEN" edited by The Society of Polymer Science, Japan, published by BAIFUKAN CO., LTD). Among these monomer components, specific examples of the divalent carboxylic acids include dibasic acids such as phthalic acid, isophthalic acid, terephthalic acid, naphthalene-2,6-dicarboxylic acid, naphthalene-2,7-dicarboxylic acid, and cyclohexane dicarboxylic acid, and anhydrides or lower alkyl esters thereof. It is possible to use one of these substances, or, alternatively, two or more of these substances may be used in combination.

The crystalline polyester resin can be synthesized in a manner similar to that used for synthesizing the non-crystalline polyester resin. Examples of the catalyst used for the synthesis may include a compound of an alkali metal such as sodium or lithium; a compound of an alkaline earth metal such as magnesium or calcium; a compound of a metal such as zinc, manganese, antimony, titanium, tin, zirconium, germanium, or aluminum; a phosphorous acid compound; a phosphoric acid compound; and an amine compound. Specific examples thereof include the following compounds.

Specific examples include sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributyl antimony, tin formate, tin oxalate, tetraphenyl tin, dibutyl tin dichloride, dibutyl tin oxide, diphenyl tin oxide, zirconium tetrabutoxide, zirconium naphthenate, zirconyl carbonate, zirconyl acetate, zirconyl stearate, zirconyl octylate, germanium oxide, aluminum oxide, triphenyl phosphite, tris(2,4-di-t-butylphenyl) phosphite, ethyl triphenylphosphonium bromide, triethyl amine, and triphenyl amine. Considering reactivity, antimony-containing compounds, tin-containing compounds, and titanium-containing compounds are preferred.

The amount of the catalyst to be added may be in the range of from 0.02 part by weight to 1.0 part by weight with respect to 100 parts by weight of the monomer components.

The melting temperature of the crystalline polyester resin is preferably in the range of from 50° C. to 120° C. and more preferably from 60° C. to 110° C. When the melting temperature is lower than 50° C., the shelf life of the toner and the storage stability of the toner image after fixing may be deteriorated. On the other hand, when the melting temperature is higher than 120° C. low-temperature fixing property may be less satisfactory than conventional toners.

The melting temperature of the crystalline polyester resin can be determined as a peak temperature of an endothermic peak during melting, according to a similar method to the glass transition temperature measurement of the non-crystalline polyester resin. The details will be described below.

The molecular weight of the crystalline polyester resin is preferably in the range of from 5,000 to 100,000, and more preferably from 10,000 to 50,000, in terms of weight average molecular weight (Mw) as determined by molecular weight measurement on a tetrahydrofuran (THF) soluble fraction using the GPC method. The number average molecular weight (Mn) is preferably in the range of from 2,000 to 30,000 and more preferably from 5,000 to 15.000.

When the weight average molecular weight and number average molecular weight of the crystalline polyester resin are smaller than the above ranges, the crystalline polyester resin is effective in improving the low-temperature fixing property, but there may be adverse effects on storage stability, such as toner blocking, due to softness of resin.

On the other hand, when the weight average molecular weight and number average molecular weight of the crystalline polyester resin are larger than the above ranges, there may be adverse effects on document storability, such as insufficient oozing out of the toner.

The molecular weight distribution Mw/Mn of the crystalline polyester resin is preferably in the range of from 1.5 to 20 and more preferably from 2 to 5.

The acid value of the crystalline polyester resin is preferably in the range of from 4 mgKOH/g to 20 mgKOH/g and more preferably from 8 mgKOH/g to 15 mgKOH/g. The hydroxyl value is preferably in the range of from 3 mgKOH/g to 30 mgKOH/g and more preferably from 5 mgKOH/g to 10 mgKOH/g.

The content of the crystalline polyester resin in the binder resin is preferably in the range of from 2% to 20% by weight and more preferably from 2% to 14% by weight. When the content of the crystalline polyester resin is more than 20% by weight, the domain size of the crystalline polyester resin is larger and the resin is more easily exposed to the toner surface, whereby the fluidity of toner powder may be lowered and the charging property may be deteriorated. When the content of the crystalline polyester resin in the binder is smaller than 2% by weight, adequate low-temperature fixing property may not be obtained.

Other Resins:

The binder resin may include one or more other additional resins, in addition to the non-crystalline polyester resin and the crystalline polyester resin. Examples of the additional resins include other non-crystalline resins and other crystalline resins.

Examples of the additional non-crystalline resins include polystyrene, poly(meth)acrylic acid and esterified products thereof.

Specific examples include a polymer of a monomer, a copolymer obtained from two or more monomers, and a mixture thereof. Examples of the monomer or monomers include styrenes such as styrene, parachlorostyrene, and α-methyl styrene; esters having a vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; vinyl nitrites such as acrylonitrile and methacrylonitrile; vinyl ethers such as vinyl methyl ether and vinyl isobutyl ether; vinyl ketones such as vinyl methyl ketone, vinyl ethyl ketone, and vinyl isopropenyl ketone; and olefins such as ethylene, propylene, and butadiene. Further examples of the additional non-crystalline resins include non-vinyl condensed resins such as epoxy resins, polyester resins, polyurethane resins, polyamide resins, cellulose resins, and polyether resins; a mixture of at least one of these non-vinyl condensed resins and at least one of the aforementioned vinyl resins; and a graft polymer obtained by polymerizing a vinyl monomer in the presence of at least one of these non-vinyl condensed resins. Among these, considering charging property or fixing property, styrene-acrylic copolymer resins, particularly styrene-butyl acrylate copolymer resins, are preferred.

Examples of the additional crystalline resins include a vinyl resin obtained from one of, or from a combination of two or more of, (meth)acrylic esters of long chain alkyls or alkenyls, such as amyl (meth)acrylate, hexyl (meth)acrylate, heptyl (meth)acrylate, octyl (meth)acrylate, nonyl (meth) acrylate, decyl (meth)acrylate, undecyl (meth)acrylate, tridecyl (meth)acrylate, myristyl (meth)acrylate, cetyl (meth) acrylate, stearyl (meth)acrylate, oleyl (meth)acrylate, and behenyl (meth)acrylate; and polyolefins formed from ethylene, propylene, butadiene, isoprene, or the like.

The content of the additional resins in the binder resin may be less than 3% by weight.

In the binder resin, the content of tetrahydrofuran (hereinafter, abbreviated as "THF") insoluble matter may be from 0% to 20%. When the content of THF insoluble matter is larger than 20%, the offset resistance may be improved, but the gloss of the image may be lowered and an optical transparency for OHP may be also deteriorated.

The method of measuring the content of THF insoluble matter may include: dissolving the resin in THF such that the concentration of the resin becomes about 10% by weight; filtering the resulting solution with a membrane filter or the like; and then drying and weighing the residue on the filter.

Releasing Agent

The toner of an exemplary embodiment according to the present invention may optionally contain a releasing agent. Examples of the releasing agent include low molecular weight polyolefins such as polyethylene, polypropylene, and polybutene; silicones having a softening temperature; aliphatic acid amides such as oleic acid amide, erucic acid amide, recinoleic acid amide, stearic acid amide; plant waxes such as carnauba wax, rice wax, candelilla wax, haze wax, and jojoba oil; animal waxes such as beeswax: mineral or petroleum waxes such as montan wax, ozokerite, ceresin, paraffin wax, microcrystalline wax, and Fischer-Tropsch wax; ester waxes formed from higher fatty acids and higher alcohols, such as stearyl stearate and behenyl behenate; ester waxes formed from higher fatty acids and mono-hydric or polyhydric lower alcohols, such as butyl stearate, propyl oleate, glyceride monostearate, glyceride distearate, and pentaerythritol tetrabehenate; ester waxes formed from higher fatty acids and multimeric polyhydric alcohols, such as diethyleneglycol monostearate, dipropyleneglycol distearate, diglyceride distearate, and triglyceride tetrastearate; sorbitan higher fatty acid ester waxes such as sorbitan monostearate; and cholesterol higher fatty acid ester waxes such as cholesteryl stearate.

In the present invention, the releasing agent may be used singly, or in combination of two or more thereof.

The melting temperature of the releasing agent is preferably from 40° C. to 150° C. and more preferably from 70° C. to 110° C.

The amount of the releasing agent to be added is preferably in the range of from 5 parts to 25 parts by weight, and more preferably from 7 parts to 20 parts by weight, with respect to 100 parts by weight of the binder resin.

When the amount of the added releasing agent is smaller than the above range, releasability from a fixing member may be insufficient upon fixing, whereby offset may occur more easily.

On the other hand, when the amount of the added releasing agent is larger than the above range, coloring property may be deteriorated and the transparency may be reduced.

When the content of the releasing agent is excessive, the releasing agent on the surface or inside of the fixed color image may deteriorate OHP projection property. Further, when the toner is used in a two-component developer, it is possible that the releasing agent may shift to the carrier due to sliding and rubbing between the toner and the carrier, whereby the charging performance of the developer may change with passage of time. When the toner is used as a one-component developer, it is possible that the releasing agent may shift to a charging blade due to sliding and rubbing between the toner and the blade, whereby the charging performance of the developer may change with passage of time. Furthermore, an excessive amount of the releasing agent may also lead to worsened fluidity of the toner. As described above, an excessively high content of the releasing agent may lead to deterioration in color image quality and reliability.

Coloring Agent

The toner according to an exemplary embodiment of the present invention contains optionally a coloring agent.

The coloring agent is not particularly limited, and may be a known coloring agent. Specifically, for example, the following coloring agents are usable.

Examples of yellow pigments include zinc yellow, yellow iron oxide, cadmium yellow, chrome yellow, hanza yellow, hanza yellow 10G, benzidine yellow G, benzidine yellow GR, threne yellow, quinoline yellow, and permanent yellow NCG. In particular, C.I. Pigment Yellow 17, C.I. Pigment Yellow 74, C.I. Pigment Yellow 97, C.I. Pigment Yellow 155, C.I. Pigment Yellow 180, and C.I. Pigment Yellow 185, and the like are preferred.

Examples of magenta pigments include red iron oxide, cadmium red, red lead, mercury sulfide, Watchung Red, permanent red 4R, lithol red, brilliant carmine 3B, brilliant carmine 6B, DuPont oil red, pyrazolone red, rhodamine B lake, lake red C, rose Bengal, eoxine red, and alizarin lake; naphthol-based pigments such as Pigment Red 31, Pigment Red 146, Pigment Red 147, Pigment Red 150, Pigment Red 176, Pigment Red 238, and Pigment Red 269; and quinachridone-based pigments such as Pigment Red 122, Pigment Red 202, and Pigment Red 209. Among these, considering particularly productivity and charging property, Pigment Red 185, Pigment Red 238, Pigment Red 269, and Pigment Red 122 are preferred.

Examples of cyan pigments include iron blue pigment, cobalt blue, alkali blue lake, Victoria blue lake, fast sky blue, indanthrene blue BC, aniline blue, ultramarine blue, chalco oil blue, methylene blue chloride, phthalocyanine blue, phthalocyanine green, and Malachite green oxalate. In particular, C.I. Pigment Blue 15:1, C.I. Pigment Blue 15:3, and the like are preferred.

Examples of orange pigments include red chrome yellow, molybdenum orange, permanent orange GTR, pyrazolone orange, Vulcan orange, benzidine orange G, indanthrene brilliant orange RK, and indanthrene brilliant orange GK. Examples of purple pigments include manganese purple, fast violet B, and methyl violet lake. Examples of green pigments include chromium oxide, chrome green, pigment green, Malachite green, and final yellow green G.

Examples of white pigments include zinc white, titanium oxide, antimony white, and zinc sulfide.

Examples of extender pigments include barite powder, barium carbonate, clay, silica, white carbon, talc, and alumna white. Further examples include various dyes such as acridine dyes, xanthenes dyes, azo dyes, benzoquinone dyes, azine dyes, anthraquinone dyes, thioindigo dyes, dioxazine dyes, thiazine dyes, azomethine dyes, indigo dyes, thioindigo dyes, phthalocyanine dyes, aniline black dyes, polymethine dyes, triphenylmethane dyes, diphenylmethane dyes, thiazine dyes, thiazole dyes, and xanthenes dyes. The coloring agent may be used singly or in the form of a mixture of two or more thereof.

Examples of black pigments used for black toners include carbon black, copper oxide, manganese dioxide, aniline black, and activated carbon. In particular, carbon black is preferably used. Carbon black has relatively high dispersibility and does not particularly require a special dispersing process. Carbon black may be produced by a method that is similar to that use for producing coloring agents of other colors.

The coloring agent may be selected from the viewpoints of hue angle, chroma, lightness, weather resistance, OHP transparency, and dispersibility in toner. The coloring agent may be added in an amount of from 4% to 15% by weight with respect to the total weight of the toner. Further, when using a magnetic material or the like as a black pigment, unlike other coloring agents, the magnetic material may be added in an amount of from 12% to 240% by weight. Specifically, the magnetic material may be a material that can be magnetized in a magnetic field, examples of which include ferromagnetic powders such as iron powder, cobalt powder, and nickel powder, and compounds such as ferrite and magnetite. When toner is prepared in a water phase, the extent that the magnetic material transfers to the water phase should be considered, and the surface of the magnetic material may be modified, for example through a hydrophobicity-imparting treatment, prior to the production of the toner.

The content of the coloring agent in the toner is preferably as high as possible within a range in which the surface smoothness of the image after fixing is not impaired. A higher content of the coloring agent gives an image having the same image density with a smaller image thickness, thus being preferable in consideration of suppression an offset phenomenon.

Other Components

Besides the aforementioned components, various kinds of components such as a charge controlling agent and an external additive may be added to the specific toner, as necessary.

Examples of the charge controlling agent include salicylic acid metal salts, metal-containing azo compounds, nigrosine, and quaternary ammonium salts. In general, the charge controlling agent is used to improve charging property.

Examples of the external additive include the following inorganic particles and organic particles.

In general, the inorganic particles are used to improve fluidity.

Examples of the inorganic particles include particles of silica, alumina, titanium oxide, barium titanate, magnesium titanate, calcium titanate, strontium titanate, zinc oxide, silica sand, clay, mica, wollastonite, diatomite, cerium chloride, red iron oxide, chromium oxide, cerium oxide, antimony trioxide, magnesium oxide, zirconium oxide, silicon carbide, or silicon nitride.

Among the inorganic particles, titanium-containing particles and silica-containing particles are preferred, and particles that have been subjected to a hydrophobicity-imparting treatment are preferred.

The primary particle diameter of the inorganic particles may be from 1 nm to 1,000 nm. The amount of the inorganic particles to be externally added may be from 0.01 part to 20 parts by weight with respect to 100 parts by weight of the toner.

Examples of the organic particles include particles of polystyrene, polymethyl methacrylate, or polyvinylidene fluoride. The particles obtained by treating the surface of these particles with a silicone-containing compound and/or a fluorine-containing compound may be used. In general, the organic particles are used to improve cleanability or transferability.

Toner Properties

The volume average particle diameter of toner is preferably from 1.0 μm to 20 μm, more preferably 2.0 μm to 8.0 μm, and still more preferably 4.0 μm to 8.0 μm. The number average particle diameter is preferably 10 μm or less, more preferably 2.0 μm to 8.0 μm, and still more preferably 4.0 μm to 8.0 μm.

Method of Producing Toner

The toner may be produced in a wet process in which the toner is formed in an acidic or alkaline aqueous medium, such as an aggregation and coalescence process, a suspension polymerization process, a dissolution suspension granulation process, a dissolution suspension process, or a dissolution emulsification aggregation coalescence process. In particular, the aggregation and coalescence process is preferred.

A method of producing a toner according to the aggregation and coalescence process may include, for example:

a first aggregation step of mixing a resin particle dispersion liquid, a coloring agent particle dispersion liquid, and a releasing agent particle dispersion liquid so as to form core aggregated particles, wherein a first resin particles having a particle diameter of 1 μm or less are dispersed in the resin particle dispersion liquid, coloring agent particles having a particle diameter of 1 μm or less are dispersed in the coloring agent particle dispersion liquid, releasing agent particles having a particle diameter of 1 μm or less are dispersed in the releasing agent particle dispersion liquid, and the core aggregated particles contain the first resin particles, the coloring agent particles, and the releasing agent particles;

a second aggregation step of forming a shell layer containing second resin particles on the surface of the core aggregated particles so as to form core/shell aggregated particles; and a fusion and coalescence step of fusing and coalescing the core/shell aggregated particles by heating at a temperature that is equal to or higher than the glass transition temperature of the first resin particles or the second resin particles.

In the following, each step will be explained in detail.

Preparation of Dispersion Liquids:

In the aforementioned aggregation and coalescence process, for example, a resin particle dispersion liquid (a resin-silica particle dispersion liquid), a coloring agent particle dispersion liquid, and a releasing agent particle dispersion liquid are prepared.

For example, crystalline resin particles can be formed by applying, with a dispersing machine, a shearing force to a liquid in which an aqueous medium and a crystalline resin are mixed. In this process, the particles may be formed by decreasing the viscosity of the resin component through heating. Further, a dispersant may be used so as to stabilize the dispersed resin particles. Furthermore, when the resin is soluble in an oil-based solvent that has a relatively low solubility in water, the resin may be dissolved in the solvent and dispersed in water along with a dispersant and a polymer electrolyte into particles, and then the solvent may be distilled away by heating or reducing pressure, whereby a dispersion liquid of crystalline resin particles is obtained.

A dispersion liquid of non-crystalline resin particles is prepared in a manner similar to the process described above. When two or more non-crystalline polyester resins are used, separate resin particle dispersion liquids may be prepared for the respective non-crystalline resins.

Examples of the aqueous medium include water such as distilled water or ion-exchange water, and alcohols. The aqueous medium is preferably water alone.

Examples of the dispersant used in the emulsification step include water-soluble polymers such as polyvinyl alcohol, methyl cellulose, ethyl cellulose, hydroxyethyl cellulose, carboxymethyl cellulose, sodium polyacrylate, and sodium polymethacrylate; surfactants (for example, anionic surfactants such as sodium dodecylbenzenesulfonate, sodium octadecylsulfate, sodium oleate, sodium laurate, and potassium stearate, cationic surfactants such as laurylamine acetate, stearylamine acetate, and lauryltrimethylammonium chloride, amphoteric surfactants such as lauryldimethylamine oxide, and nonionic surfactants such as polyoxyethylene alkyl ether, polyoxyethylene alkylphenyl ether, and polyoxyethylene alkyl amine); and inorganic salts such as tricalcium phosphate, aluminum hydroxide, calcium sulfate, calcium carbonate, and barium carbonate.

Regarding a method of dispersing the emulsion (dispersion liquid), the disperser used for dispersing the emulsion may be a homogenizer, a homo mixer, a pressurized kneader, an extruder, or a media disperser, for example.

It is also possible to prepare the resin particle dispersion liquid by, for example, a phase reversal emulsification process. In the phase reversal emulsification process, a resin to be dispersed is dissolved in an organic solvent in which the resin can dissolve, a neutralizing agent and/or a dispersion stabilizer is optionally added, a water medium is dropped while stirring to obtain emulsified particles, and the organic solvent is removed from the resultant resin particle dispersion liquid so as to obtain an emulsion (resin particle dispersion liquid). In this process, the timing of adding the neutralizing agent and/or dispersion stabilizer may be changed to another timing than that described above.

Examples of the organic solvent in which the resin is to be dissolved (resin-dissolving solvent) include formic esters, acetic esters, lactic esters, ketones, ethers, benzenes, and carbon halides.

Specific examples thereof include alkyl (such as methyl, ethyl, n-propyl, isopropyl, n-butyl, isobutyl, sec-butyl, and t-butyl) esters of formic acid, acetic acid, lactic acid and the like; methyl ketones such as acetone, MEK, MPK, MIPK, MBK, and MIBK; ethers such as diethyl ether and diisopropyl ether; substituted heterocycles such as toluene, xylene, and benzene; and carbon halides such as carbon tetrachloride, methylene chloride, 1,2-dichloroethane, 1,1,2-trichloroethane, trichloroethylene, chloroform, monochlorobenzene, and dichloroethylidene. The organic solvent may be used singly or in combination of two or more thereof. In consideration of availability, recovering easiness upon solvent removal, and environmental consideration, acetic esters, methyl ketones, and ethers, which are low boiling temperature solvents, are usually preferable. In particular, acetone, methylethyl ketone, acetic acid, ethyl acetate, and butyl acetate are preferred. When the organic solvent remains in the resin particles, the organic solvent may work as VOC (Volatile Organic Compound); therefore, an organic solvent that has a relatively high volatility may be used.

As the aqueous solvent, ion-exchange water is used basically, which may contain a water-soluble organic solvent within such an extent that oil droplets are not broken.

Examples of the water-soluble solvent include alcohols having short carbon chains, such as methanol, ethanol, 1-propanol, 2-propanol, 1-butanol, 2-butanol, t-butanol, and 1-pentanol; ethyleneglycol monoalkyl ethers such as ethyleneglycol monomethyl ether, ethyleneglycol monoethyl ether, and ethyleneglycol monobutyl ether; ethers; diols; THF; and acetone.

The mixing ratio of the water-soluble organic solvent to ion-exchange water may be in the range of from 1% to 50% by weight and more preferably from 1% to 30% by weight, and the resultant mixture may be used as an aqueous component.

The water-soluble organic solvent may be mixed with ion-exchange water that is to be added to the resin particle dispersion liquid. Moreover, the water-soluble organic solvent may also be added to the solution in which the resin is dissolved. When the water-soluble organic solvent is added to the solution, it is possible to control the wettability between the resin and the resin-dissolving solvent, and the water-soluble organic solvent may also function to lower the viscosity of the solution after the resin is dissolved.

Still further, a dispersant may be added to the resin solution or the aqueous component in order to maintain emulsion in a stable dispersion state, if necessary.

The dispersant may be a substance that forms a hydrophilic colloid in the aqueous component, and examples thereof include cellulose derivatives such as hydroxymethyl cellulose, hydroxyethyl cellulose, and hydroxypropyl cellulose; synthetic polymers such as polyvinyl alcohol, polyvinyl pyrrolidone, polyacrylamide, polyacrylic acid salts, and polymethacrylic acid salts; gelatin; gum arabic; and agar.

Further examples of the dispersant include solid fine powder of silica, titanium oxide, alumina, tricalcium phosphate, calcium carbonate, calcium sulfate, and barium carbonate.

The dispersant may be added usually in such an amount that the concentration thereof in the aqueous component is from 0% to 20% by weight and preferably from 0% to 10% by weight.

The dispersant may be a surfactant.

Examples of the surfactant include those described below as examples of the surfactant used in the coloring agent dispersion liquid.

Examples of the surfactant also include, besides natural surfactants such as saponin, cationic surfactants such as hydrochloric or acetic acid salts of alkyl amines, quaternary ammonium salts, and glycerins; and anionic surfactants such fatty acid soaps, sulfuric esters, alkylnaphthalene sulfonic acid salts, sulfonic acid salts, phosphoric acid, phosphoric esters, and sulfosuccinic acid salts. Anionic surfactants and nonionic surfactants are preferable.

In order to control the pH of the emulsion, a neutralizing agent may be added. Examples of the neutralizing agent include common acids and alkalis such as nitric acid, hydrochloric acid, sodium hydroxide, and ammonia.

The method of removing the organic solvent from the emulsion may be a method of vaporizing the organic solvent contained in the emulsion at a normal temperature (from 15° C. to 35° C.) or by heating or a method in which the vaporizing method is combined with pressure reduction.

The volume average particle diameter of the resin particles in the resin particle dispersion liquid thus obtained is preferably 1 μm or less, and more preferably from 100 μm to 300 nm, in terms of making it easy to adjust the volume average particle diameter and particle diameter distribution of the toner particles to desired values.

The volume average particle diameter of the resin particles can be measured, for example, with a laser diffraction particle diameter analyzer (LA-700, manufactured by Horiba Seisakusho Co., Ltd.).

The solid content of the resin particle dispersion liquid is preferably from 5 parts to 40 parts by weight, more preferably from 10 parts by weight to 30 parts by weight, and still more preferably from 15 parts by weight to 25 parts by weight, with respect to 100 parts by weight of the resin particle dispersion liquid.

When the solid content is less than 5 parts by weight, the viscosity of the resin particle dispersion liquid is decreased, which may deteriorate the stability of the particles or may be cost-ineffective at transportation. On the other hand, when the solid content is more than 40 parts by weight, the viscosity is elevated too much, whereby the resin particle dispersion liquid may not be stirred homogenously and polymerization may not proceed satisfactorily.

A coloring agent particle dispersion liquid may be prepared by a known method. The coloring agent particles may be dispersed with, for example, a rotation shearing homogenizer, a media dispersing machine such as a ball mill, a sand mill, or an attritor, or a high-pressure counter collision dispersing machine.

In addition, a coloring agent particle dispersion liquid can be prepared by dispersing coloring agent particles in an aqueous solvent, using an ionic surfactant having a polarity and a homogenizer as described above.

The volume average particle diameter of the coloring agent particles in the colorings agent particle dispersion liquid is preferably 1 μm or less, and more preferably from 100 nm to 300 nm, in consideration of making it easy to adjust the volume average particle diameter and particle diameter distribution of the toner particles to desired values.

The releasing agent particle dispersion liquid can be prepared, for example by: dispersing the releasing agent in water, together with an ionic surfactant and a polymer electrolyte such as a polymeric acid or a polymeric base; and then heating the resultant dispersion liquid to a temperature above the melting temperature and dispersing the releasing agent into particles with a homogenizer or pressure discharge disperser, which can apply a strong shearing force. According to this procedure, a releasing agent particle dispersion liquid containing releasing agent particles having a particle diameter of 1 μm or less can be obtained, for example.

The volume average particle diameter of the releasing agent particles in the releasing agent particle dispersion liquid is preferably 1 μm or less, and more preferably from 100 nm to 300 nm, in terms of making it easy to adjust the volume average particle diameter and particle diameter distribution of the toner particles to desired values.

Surfactants may be used to stabilize the dispersion state of the respective dispersion liquids described above. Examples of the surfactant include anionic surfactants such as sulfuric esters, sulfonic esters, phosphoric esters, and soaps; cationic surfactants such as amine-salt surfactants and quaternary-ammonium-salt surfactants; and nonionic surfactants such as polyethylene glycols, alkylphenol ethyleneoxide adducts, and polyhydric alcohols. Among these, ionic surfactants are preferable, and anionic surfactants and cationic surfactants are more preferable. The surfactant may be used singly or in combination of two or more thereof.

Specific examples of the anionic surfactant include: fatty acid soaps such as potassium laurate, sodium oleate, and sodium salt of castor oil; sulfuric esters such as octyl sulfate, lauryl sulfate, laurylether sulfate, and nonylphenylether sulfate; salts of alkyl sulfonates such as lauryl sulfonate; salts of alkylbenzene sulfonates such as dodecylbenzene sulfonate; salts of alkyl naphthalene sulfonates such as triisopropyl naphthalene sulfonate and dibutyl naphthalene sulfonate; sulfonic acid salts such as naphthalene sulfonate formalin condensate, monooctyl sulfosuccinate, dioctyl sulfosuccinate, lauric acid amide sulfonate, and oleic acid amide sulfonate; phosphoric esters such as lauryl phosphate, isopropyl phosphate, and nonylphenylether phosphate; salts of dialkyl sulfosuccinates such as sodium dioctyl sulfosuccinate; and sulfosuccinic acid salts such as disodium lauryl sulfosuccinate.

Specific examples of the cationic surfactant include: amine salts such as hydrochloric acid salt of laurylamine, hydrochloric acid salt of stearylamine, acetic acid salt of oleylamine, acetic acid salt of stearylamine, and acetic acid salt of stearylaminopropylamine; and quaternary ammonium salts such as lauryltrimethylammonium chloride, dilauryldimethylammonium chloride, distearyldimethylammonium chloride, distearyldimethylammonium chloride, lauryldihydroxyethylmethylammonium chloride, oleylbispolyoxyethylenemethylammonium chloride, lauroylaminopropyldimethylethylammonium ethosulfate, lauroylaminopropyldimethylhydroxyethylammonium perchlorate, alkylbenzenetrimethylammonium chloride, and alkyltrimethylammonium chloride.

Specific examples of the nonionic surfactant may include: alkyl ethers such as polyoxyethylene octyl ether, polyoxyethylene lauryl ether, polyoxyethylene stearyl ether, and polyoxyethylene oleyl ether; alkylphenyl ethers such as polyoxyethylene octylphenyl ether and polyoxyethylene nonylphenyl ether; alkyl esters such as polyoxyethylene laurate, polyoxyethylene stearate, and polyoxyethylene oleate; alkyl amines such as polyoxyethylene laurylamino ether, polyoxyethylene stearylamino ether, polyoxyethylene oleylamino ether, polyoxyethylene soybean amino ether, and polyoxyethylene beef tallow amino ether; alkylamides such as polyoxyethyelene lauric acid amide, polyoxyethylene stearic acid amide, and polyoxyethylene oleic acid amide; vegetable oil ethers such as polyoxyethylene castor oil ether and polyoxyethylene rapeseed oil ether; alkanol amides such as lauric acid diethanol amide, stearic acid diethanol amide, and oleic acid diethanol amide; and sorbtan ester ethers such as polyoxyethylene sorbitan monolaurate, polyoxyethylene sorbitan monopalmitate, polyoxyethylene sorbitan monostearate, and polyoxyethylene sorbitan monooleate.

The content of the surfactant in each dispersion liquid may be a content at which the effects of the present invention are not impaired. The content of the surfactant is usually small. Specifically, the content of the surfactant is preferably in the range of from 0.01% to 10% by weight, more preferably from 0.05% to 5% by weight, and still more preferably from 0.1% to 2% by weight. When the content of the surfactant is less than 0.01% by weight, the dispersion liquid (e.g., the resin particle dispersion liquid, coloring agent dispersion liquid, or releasing agent dispersion liquid) becomes unstable and undesired aggregate may be formed, and/or separation of particular particles may occur due to difference in stability among particles at the time of forming aggregated particles. On the other hand, when the content of the surfactant is larger than 10% by weight, the particle diameter distribution may be broadened and/or it may be difficult to control the particle diameter. In general, a toner dispersion liquid having a large particle diameter that is prepared by suspension polymerization is stable even if the amount of the surfactant used is small.

Aggregation Step:

In the aggregation step, the crystalline resin particle dispersion liquid, the non-crystalline resin particle dispersion liquid of, the coloring agent dispersion liquid, and other optional dispersion liquids are mixed first to form a mixed solution. The resultant mixed solution is heated to a temperature that is equal to or lower than the glass transition temperature of the non-crystalline resin, whereby aggregation proceeds to form aggregated particles. The formation of the aggregated particles is conducted by setting the pH of the mixed solution to acidic while stirring. The pH is preferably in the range of from 2 to 7, more preferably from 2 to 6, and still more preferably from 2.4 to 5. It is also effective to use a flocculant in the above process.

The flocculant to be used may be a surfactant having the opposite polarity to that of the surfactant used as a dispersant, an inorganic metal salt, or a divalent or higher-valent metal complex. In particular, the flocculant is preferably the metal complex since use of the metal complex enables reduction in the amount of the surfactant to be used and improvement in the charging property.

Examples of the inorganic metal salt include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide. Among these, aluminum salts and polymers thereof are preferred. Regarding the valency of the inorganic metal salt, divalent is better than mono-valent, trivalent is better than divalent, and tetravalent is better than trivalent, in terms of obtaining a sharper particle diameter distribution.

When the diameter of the aggregated particles reaches a desired particle diameter, non-crystalline resin particles may be further added to form a toner having a configuration in which the non-crystalline resin covers the surface of the core aggregated particles. In view of preventing the crystalline resin from being exposed to the toner surface, the non-crystalline resin particles to be added this time may have a higher molecular weight. Before the further addition of the non-crystalline resin particles, a flocculant may be added and/or the pH may be adjusted.

Fusion and Coalescence Step:

In the fusion step, the progress of aggregation is stopped by elevating the pH of the suspension of the aggregated particles to a range of from 3 to 9 while stirring under conditions similar to those in the above aggregation step, and then the aggregated particles are fused by being heating to a temperature that is equal to or higher than the glass transition temperature of the non-crystalline resin having a higher molecular weight or the melting temperature of the crystalline resin. The heating time is such a time as to ensure fusion, and may be from about 0.5 hour to 10 hours.

After the fusion and coalescence step, the toner particles formed in the solution are processed through a known cleaning step, a solid/liquid separation step, and a drying step, so that dried toner particles are obtained.

In the cleaning step, sufficient displacement washing with ion-exchange water may be conducted in consideration of charging property. There is no limitation on the solid/liquid separation step, and suction filtration, pressure filtration, or the like may be applied. Further, there is not limitation on the drying step, and freeze-drying, flash jet drying, fluidization drying, vibration fluidization drying, or the like may be applied, in consideration of productivity.

Addition of External Additives:

Toner can be obtained by optionally mixing the toner particles obtained as described above with an external additive and/or other additives. Mixing may be performed with a known mixing machine such as a V-type blender, a Henschel mixer, or a Redige mixer.

As other additives, if necessary, various additives may be used. Examples of other additives include a fluidizing agent; a cleaning auxiliary such as polystyrene particles, polymethyl methacrylate particles, or polyvinylidene fluoride particles; an auxiliary transferring agent.

Specific Carrier

The specific carrier has a core material and a resin coating layer covering the surface of the core material. The resin coating layer contains a copolymer that contains a nitrogen-containing acrylic or methacrylic ester and an alicyclic acrylic or methacrylic ester. There is no particular limitation on the core material, and a known carrier may be used.

Core Material:

The core material of the carrier may have a volume electric resistivity of from $1\times10^{7.5}$ Ω·cm to $1\times10^{9.5}$ Ω·cm. When the volume electric resistivity is lower than $1\times10^{7.5}$ Ω·cm, charge may be injected into the carrier and the carrier itself may be developed when the toner concentration in the developer is decreased by repeated copying. On the other hand, when the volume electric resistivity is larger than $1\times10^{9.5}$ Ω·cm, there may be adverse effects on the resultant images, such as a significant edge effect and a pseudo contour.

The core material is not particularly limited, and may satisfy the conditions described above. Examples of the core material include a magnetic metal such as iron, steel, nickel, or cobalt; an alloy thereof with at least one of manganese, chromium, a rare earth metal, or the like; and a magnetic oxide such as ferrite or magnetite. Among these, ferrite, particularly an alloy of ferrite with at least one of manganese, lithium, strontium, magnesium, or the like, is preferred in consideration of the surface property and resistivity of the core material.

The volume average particle diameter of the core material is preferably from 10 μm to 500 μm and more preferably from 30 μm to 100 μm.

Resin Coating Layer:

The resin coating layer contains a copolymer that contains a nitrogen-containing (meth)acrylic ester and an alicyclic (meth)acrylic ester.

Examples of the nitrogen-containing (meth)acrylic ester include an ester compound (such as polyamide and polyimide), dimethylaminomethyl methacrylate, dimethylaminoethyl methacrylate, N,N-dimethylaminomethyl acrylate, N,N-dimethylaminoethyl acrylate, N,N-dimethylaminopropyl acrylate, N,N-dimethylaminomethyl methacrylate, N,N-dimethylaminoethyl methacrylate, N,N-dimethylaminopropyl methacrylate, N,N-diethylaminomethyl acrylate, N,N-diethylaminoethyl acrylate, N,N-diethylaminopropyl acrylate, N,N-diethylaminomethyl methacrylate, N,N-diethylaminoethyl methacrylate, N,N-diethylaminopropyl methacrylate, N,N-dipropylaminomethyl acrylate, N,N-dipropylaminoethyl acrylate, N,N-dipropylaminopropyl acrylate, N,N-dipropylaminomethyl methacrylate, N,N-dipropylaminoethyl methacrylate, N,N-dipropylaminopropyl methacrylate, N,N-methylethylaminomethyl acrylate, N,N-methylethylaminoethyl acrylate, N,N-methylethylaminopropyl acrylate, N,N-methylethylaminomethyl methacrylate, N,N-methylethylaminoethyl methacrylate, N,N-methylethylaminopropyl methacrylate, N,N-methylpropylaminomethyl acrylate, N,N-methylpropylaminoethyl acrylate, N,N-methylpropylaminopropyl acrylate, N,N-methylpropylaminomethyl methacrylate, N,N-methylpropylaminoethyl methacrylate, N,N-methylpropylaminopropyl methacrylate, N,N-ethylpropylaminomethyl acrylate, N,N-ethylpropylaminoethyl acrylate, N,N-ethylpropylaminopropyl acrylate, N,N-ethylpropylaminomethyl methacrylate, N,N-ethylpropylaminoethyl methacrylate, and N,N-ethylpropylaminopropyl methacrylate. Among these, dimethylaminoethyl methacrylate is preferred from the viewpoint of charge imparting ability.

Examples of the alicyclic (meth)acrylic ester include cyclohexyl (meth)acrylate, cyclopentyl (meth)acrylate, adamantyl (meth)acrylate, cyclopropyl (meth)acrylate, cyclobutyl (meth)acrylate, cycloheptyl (meth)acrylate, cyclooctyl (meth)acrylate, cyclononyl (meth)acrylate, cyclodecyl (meth)acrylate, isobonyl (meth)acrylate, norbonyl (meth) acrylate, and boronyl (meth)acrylate. Among these, cyclohexyl (meth)acrylate and cyclopentyl (meth)acrylate are preferred.

The copolymer may contain one or more other components within the range in which the effect according to the exemplary embodiment is not impaired.

The weight average molecular weight (Mw) of the copolymer is preferably from 30,000 to 150,000, more preferably from 40,000 to 140,000, and particularly preferably from 50,000 to 120,000 (or from about 50,000 to about 120,000), from the viewpoint of securing the strength of the resin coating layer.

Further, the resin coating layer used in this exemplary embodiment may include one or more additional resins other than the above copolymer. Examples of the additional resins include, but are not limited to, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin composed having organosiloxane bonds and modified resins thereof, fluororesins, polyester, polycarbonate, phenol resin, epoxy resin, urea resin, urethane resin, and melamine resin. It is possible to use one of these resins, or, alternatively, two or more of these resins may be used in combination.

The total content of the resin coating layer in the specific carrier is preferably in the range of from 0.5 part by weight to 10 parts by weight, more preferably from 1 part by weight to 5 parts by weight, and particularly preferably from 1 part by weight to 3 parts by weight, with respect to 100 parts by weight of the magnetic particles. When the content of the resin coating layer is less than 0.5 part by weight, the electric field for development may be easily injected because of excessive exposure of the magnetic particles to the carrier surface. On the other hand, when the content of the resin coating layer is larger than 10 parts by weight, the amount of free carrier resin powder that has been separated from the resin coating layer may be increased and the developer may include the free carrier resin powder from the beginning.

The coverage of the core material surface with the resin coating layer is preferably 80% or more, more preferably 85% or more, and preferably as close as 100%. When the coverage is less than 80%, the coated resin may peel off and the electric resistance of the carrier may decrease when used over a long time, whereby charge may be injected to the carrier. As a result, the charge-injected carrier may move to a photoreceptor, and pinholes may be formed in the image thereby.

The coverage with the resin coating layer can be evaluated by the XPS measurement. The measurement is carried out using an XPS analyzer of "JPS80" manufactured by JEOL Ltd. with MgKα X-ray at an accelerating voltage of 10 kV and an emission current of 20 mV. The principal element(s) (usually, carbon) of the resin coating layer and the principal element(s) (for example, iron and oxygen when the magnetic particles are made of iron-oxide-based material such as magnetite) of the magnetic particles are measured by the XPS measurement (in the following, description is given assuming that the magnetic particles are made of an iron-oxide-based material). Here, C1s spectrum is measured for carbon; Fe2p3/2 spectrum is measured for iron, and O1s spectrum is measured for oxygen.

Based on the spectrum for each element, the element numbers of carbon ($A_c$), oxygen ($A_O$), and iron ($A_{Fe}$) are obtained and the total element number ($A_C+A_O+A_{Fe}$) is also obtained. From the ratios of the element numbers thus obtained for carbon, oxygen, and iron, the iron content ratios of the magnetic particle alone and the particle (carrier) in which the magnetic particle is covered with the resin coating layer are obtained according to the following equation (I). Then, the coverage is obtained according to the following equation (II).

$$\text{Iron content ratio (atomic \%)}=A_{Fe}/(A_C+A_O+A_{Fe})\times 100, \quad \text{Equation (I)}$$

$$\text{Coverage(\%)}=\{1-(\text{iron content ratio of carrier})/(\text{iron content ratio of magnetic particle alone})\}\times 100. \quad \text{Equation (II)}$$

The average thickness of the resin coating layer is preferably from 0.1 μm to 10 μm, more preferably from 0.1 μm to 3.0 μm, and particularly preferably from 0.1 μm to 1.5 μm. When the average thickness of the resin coating layer is smaller than 0.1 μm, the resin coating layer may peel off and the resistance may decrease when used over a long time, or the pulverization of the carrier is difficult to control sufficiently. On the other hand, when the average thickness of the resin coating layer is larger than 10 μm, the time it takes for the charge amount reaches the saturated charge may be longer.

When the specific gravity of the magnetic particles is represented by ρ (dimensionless), the volume average particle diameter of the magnetic particles is represented by d (μm), the average specific gravity of the resin coating layer is represented by $\rho_C$, and the total content of the resin coating layer with respect to 100 parts by weight of the magnetic particles is represented by $W_C$ (part by weight), the average thickness (μm) of the resin coating layer can be obtained by the following formula:

$$\text{The average thickness (μm)}=[\text{amount of coating resin per one carrier particle (including all of the additives such as a conductive agent)/surface area per one carrier particle}]/\text{average specific gravity of resin coating layer}=[4/3\pi\times(d/2)^3\times\rho\times W_C]/[4\pi\times(d/2)^2]/\rho_C=(1/6)\times(d\times\rho\times W_C/\rho_C)$$

Conductive Agent:

The resin coating layer may contain optionally a conductive agent for the purpose of, for example, controlling the electric resistance.

Examples of the conductive agent include particles of a metal such as gold, silver, or copper; carbon black, ketchen black; acetylene black; particles of a semiconductor oxide such as titanium oxide or zinc oxide; and particles that are obtained by coating the surface of powder (such as powder of titanium oxide, zinc oxide, barium sulfate, aluminum borate, or potassium titanate) with tin oxide, carbon black, metal, or the like on.

The conductive agent may be used singly or in combination of two or more thereof.

The conductive agent is preferably carbon black particles because carbon black has satisfactory production stability, cost, conductivity, and the like.

No limitation is imposed on the kind of carbon black, but a carbon black having a DBP oil absorption of from about 50 ml/100 g to about 250 ml/100 g is preferable because of its excellent production stability.

The volume average particle diameter of the conductive agent is preferably 0.5 μm or less, more preferably from 0.05 μm to 0.5 μm, and still more preferably from 0.05 μm to 0.35 μm. When the volume average particle diameter is larger than 0.5 μm, stable charging property may not be obtained because the conductive agent easily drops off from the resin coating layer.

The volume average particle diameter of the conducive material may be measured with a laser diffraction particle diameter analyzer (LA-700, manufactured by Horiba Seisakusho Co., Ltd.).

In the measurement, 2 g of a sample is added to 50 ml of a 5% aqueous solution of a surfactant (preferably sodium alkylbenzene sulfonate), the sample is dispersed with an ultrasonic disperser (1,000 Hz) for 2 minutes to obtain a sample for measurement, and then measurement is performed.

Based on the counts for the respective channels, the accumulated volume curve is drawn from the smaller particle diameter side, and the particle diameter at which the % accumulated volume reaches 50% is assumed to be the volume average particle diameter.

The volume electric resistivity of the conductive agent is preferably from $10^1$ Ω·cm to $10^{11}$ Ω·cm and more preferably from $10^3$ Ω·cm to $10^9$ Ω·cm.

The volume electric resistivity of the conductive agent may be measured in a similar manner to that used for measuring the volume electric resistivity of the magnetic particles.

The content of the conductive agent is preferably from 1 part by weight to 50 parts by weight, and more preferably from 3 parts to 20 parts by weight, with respect to the entire resin coating layer. When the content is larger than 50 parts by weight, the electric resistance of the carrier may be lowered, and defects in images may occur due to sticking of the carrier to developed images and the like. On the other hand, when the content is smaller than 1 part by weight, the carrier may be insulating and less effective as a developing electrode, whereby the reproducibility of solid images may be deteriorated, for example an edge effect when the solid images are formed.

The resin coating layer may further contain resin particles. Examples of the resin particles include thermoplastic resin particles and thermosetting resin particles. Among these, thermosetting rein is preferred because the hardness may be easily increased. Resin particles formed by a nitrogen-containing resin that contains a nitrogen atom is preferred in view of enabling the toner to be charged negatively. The resin coating layer may include one kind of resin particles, or two or more kinds thereof in combination.

The volume average particle diameter of the resin particles is, for example, preferably from 0.1 μm to 2.0 μm and more preferably from 0.2 μm to 1.0 μm. When the volume average particle diameter is less than 0.1 μm, the dispersibility of the resin particles in the resin coating layer may be significantly lowered. On the other hand, when the volume average particle diameter is larger than 2.0 μm, the resin particles may easily separate from the resin coating layer, and the effects of the resin particles may not be obtained sufficiently.

The volume average particle diameter of the resin particles can be determined by a measurement similar to the measurement of the volume average particle diameter of the conductive agent.

Examples of the method of forming the resin coating layer on the surface of the magnetic particles include, but are not limited to, a method in which a resin coating layer forming liquid that contains a conductive agent and a coating resin in a solvent is used.

Examples of such a method include an immersion method in which the magnetic particles are immersed in the resin coating layer forming liquid; a spray method in which the resin coating layer forming liquid is sprayed onto the surface of the magnetic particles; and a kneader coater method in which the magnetic particles are mixed with the resin coating layer forming liquid while the magnetic particles are floated by a fluidizing air, and the solvent is removed. Among these, in an exemplary embodiment of the present invention, the kneader coater method is preferred.

The solvent used for the resin coating layer forming liquid is not particularly limited as long as it can dissolve only the resin, and can be selected from known solvents. Specific examples of the solvent include aromatic hydrocarbons such as toluene and xylene; ketones such as acetone and methyl ethyl ketone; and ethers such as tetrahydrofuran and dioxane.

When the resin particles is uniformly dispersed in the resin coating layer the resin particles are dispersed uniformly in the thickness direction of the resin coating layer and in the tangential direction of the carrier surface, so that the surface of the resin coating layer may be maintained in a similar condition to that of the pre-use surface condition even when the resin coating layer is abraded during a long time use of the carrier and so that an adequate ability to impart a charge to the toner may be maintained over a long time.

Further, when the conductive agent is uniformly dispersed in the resin coating layer, the conductive agent is uniformly dispersed in the thickness direction of the resin coating layer and in the tangential direction of the carrier surface, so that the surface of the resin coating layer may be maintained in a similar condition to that of the pre-use surface condition even when the resin coating layer is abraded by a long time use of the carrier, and so that carrier degradation may be prevented over a long time.

When the resin particles and conductive agent are both dispersed in the resin coating layer, the aforementioned effects may be obtained at the same time.

Carrier Properties

The volume average particle diameter of the carrier is preferably from 15 μm to 50 μm and more preferably from 25 μm to 40 μm. When the volume average particle diameter of the carrier is smaller than 15 μm, contamination with the carrier may be more significant. On the other hand, when the volume average particle diameter is larger than 50 μm, the toner may be deteriorated significantly by agitation with the carrier.

The volume average particle diameter of the carrier is measured with a laser diffraction and scattering particle diameter analyzer (LS Particle Diameter Analyzer: LS13 320, manufactured by BECKMAN COULTER Corp.).

A cumulative volume curve is drawn from the smaller particle diameter side based on the obtained particle diameter distribution determined from the counts for the respective divided particle diameter ranges (channels), and a diameter at which the cumulative volume reaches 50% of the total volume is used as the volume average particle diameter.

The shape factor SF1 of the carrier may be from 100 to 145 in consideration of obtaining both high-quality image and agitation efficiency of the developer.

The shape factor SF1 of the carrier is the value that is obtained according to the following equation (III).

$$SF1=100\pi\times(ML)^2/(4\times A) \qquad \text{Equation (II)}$$

wherein, ML is the maximum length of the carrier particle, and A is the projected area of the carrier particle. The maximum length and projected area of the carrier particle are obtained by observing a sampled carrier particle on a slide glass with an optical microscope; taking the resultant image into an image analyzer (LUZEX III, manufactured by NIRECO Corp.) via a video camera, and conducting image analysis. The number of the sampled particles is at least 100. The average value of the shape factors (according to Equation (III)) of the at least 100 particles is used as the shape factor of the carrier.

Regarding the saturation magnetization of the carrier, the saturation magnetization at 1000 Oe is preferably 40 emu/g or more, and more preferably 50 emu/g or more.

For the measurement of magnetic properties, a vibrating sample magnetometer, VSMP10-15 (manufactured by TOEI INDUSTRY CO., LTD.), is used. A measurement sample is packed in a cell having a diameter of 7 mm and a height of 5 mm, and the cell is loaded in the magnetometer. The measurement is conducted as follows: a magnetic field is applied and swept up to 1,000 Oe, then the applied magnetic field is decreased, and a hysteresis curve is drawn on a recording paper. The saturation magnetization, residual magnetization, and coercive force are obtained from the hysteresis curve data. In an exemplary embodiment of the present invention, the "saturation magnetization" refers to a magnetization that is measured at a magnetic field of 1,000 Oe.

The volume electric resistivity of the carrier is preferably in the range of from $1\times10^7$ Ω·cm to $1\times10^{15}$ Ω·cm, more preferably from $1\times10^8$ Ω·cm, to $1\times10^{14}$ Ω·cm, and still more preferably from $1\times10^8$ Ω·cm to $1\times10^{13}$ Ω·cm.

When the volume electric resistivity of the carrier exceeds $1\times10^{15}$ Ω·cm, the carrier may be high in electric resistance and may poorly serve as a developing electrode upon development, so that the reproducibility of solid images may be deteriorated such as an edge effect particularly in the solid images. On the other hand, when the volume electric resistivity is less than $1\times10^7$ Ω·cm, the carrier may be low in electric resistance, so that charge may be injected from a developer roller into the carrier and the carrier itself may be developed when the toner concentration in the developer is decreased.

The volume electric resistivity of the carrier is measured in a manner similar to the measurement of the volume electric resistivity of the magnetic particles.

Cartridge for Electrostatic Charge Image Developer, Image Forming Apparatus, and Process Cartridge Next, a cartridge for electrostatic charge image developer (hereinafter, simply abbreviated as "cartridge" in some cases) of the present exemplary embodiment according to the present invention is described below. The cartridge is attachable to and detachable from an image forming apparatus, and accommodates at least a developer to be supplied to a developing section provided in the image forming apparatus, and the developer is the aforementioned developer according to the exemplary embodiment of the present invention.

An image forming apparatus according to the exemplary embodiment includes at least an electrostatic latent image holder; a charging section that charges a surface of the electrostatic latent image holder; an electrostatic latent image forming section that forms an electrostatic latent image on the surface of the electrostatic latent image holder; a developing section that develops the electrostatic latent image into a toner image with a developer; a transfer section that transfers the toner image formed on the surface of the electrostatic latent image holder to a surface of a recording medium; and a fixing section that fixes the toner image that has been transferred to the recording medium, and the developer is an electrostatic charge image developer according to the exemplary embodiment.

The image forming apparatus is not particularly limited as long as it includes at least an electrostatic latent image holder, a charging section, an electrostatic image forming section, a developing section, a transfer section, and a fixing section as described above, and may optionally include at least one of a cleaning section, a neutralization section, or the like.

In the image forming apparatus according to the exemplary embodiment, the circumferential velocity of the developer holder contained in the developing section may be 300 mm/sec or more (or about 300 mm/sec or more). Even when the circumferential velocity of the developer holder is 300 mm/sec or more, low temperature fixing property is secured, toner sticking is prevented over a long time, and image defects are also prevented because the developer according to the exemplary embodiment is used.

Further, in the image forming apparatus according to the exemplary embodiment, the surface roughness Rz of the developer holder is preferably from 12 μm to 25 μm and more preferably from 12 μm to 22 μm. When the surface roughness is less than 12 μm, the developer may not be held on the developer holder, so that transfer irregularity may occur and image quality may be worsened particularly when the circumferential velocity of the developer holder is high. In contrast, when the surface roughness is more than 25 μm, the rate of replacement of the developer on the developer holder is decreased, so that the amount of the toner supplied to a developing portion may be decreased and image quality problems, such as concentration irregularity and low concentration, may occur.

Still further, in the image forming apparatus according to the exemplary embodiment the ratio of the circumferential velocity of the developer holder to the circumferential velocity of the electrostatic latent image holder is preferably in the range of from 1.3 to 2.0 and more preferably in the range of from 1.3 to 1.8. When the circumferential velocity ratio is less than 1.3, the supply amount of the developer relative to the required development amount may be insufficient and images may be uneven, for example in continuous development of solid images. In contrast, when the circumferential velocity ratio exceeds 2.0, scavenging (scraping off) by the developer against the developer holder may be too strong, so that developed images on the electrostatic latent image holder may be scraped off and/or the images may be disturbed, both of which may cause degradation in image quality.

The process cartridge according to the exemplary embodiment accommodates the developer according to the exemplary embodiment, and is attached to and detached from an image forming apparatus. The process cartridge has a developing section and at least one selected from an electrostatic latent image holder, a charging section, or a cleaning section. Further, the process cartridge may include optionally one or more other members, such as a neutralization section.

Hereinafter, a cartridge, an image forming apparatus, and a process cartridge in the exemplary embodiment is described below in detail with reference to drawings.

FIG. 1 is a cross-sectional view illustrating schematically a basic configuration of an image forming apparatus in one exemplary embodiment. The image forming apparatus shown in FIG. 1 has a configuration having a cartridge.

The image forming apparatus 10 shown in FIG. 1 has an electrostatic latent image holder 12, a charging section 14, an electrostatic latent image forming section 16, a developing section 18, a transfer section 20, a cleaning section 22, a neutralization section 24, a fixing section 26, and a cartridge 28.

The developer accommodated in the developing section 18 and in the cartridge 28 is the developer according to the exemplary embodiment.

FIG. 1 illustrates only a configuration having one developing section 18 and one cartridge 28 accommodating the developer of the exemplary embodiment; however, in the case of a color image forming apparatus for example, a configuration having the developing sections 18 and the cartridges 28, both in numbers corresponding to the configuration of the image forming apparatus, may be adopted.

Figure 2:
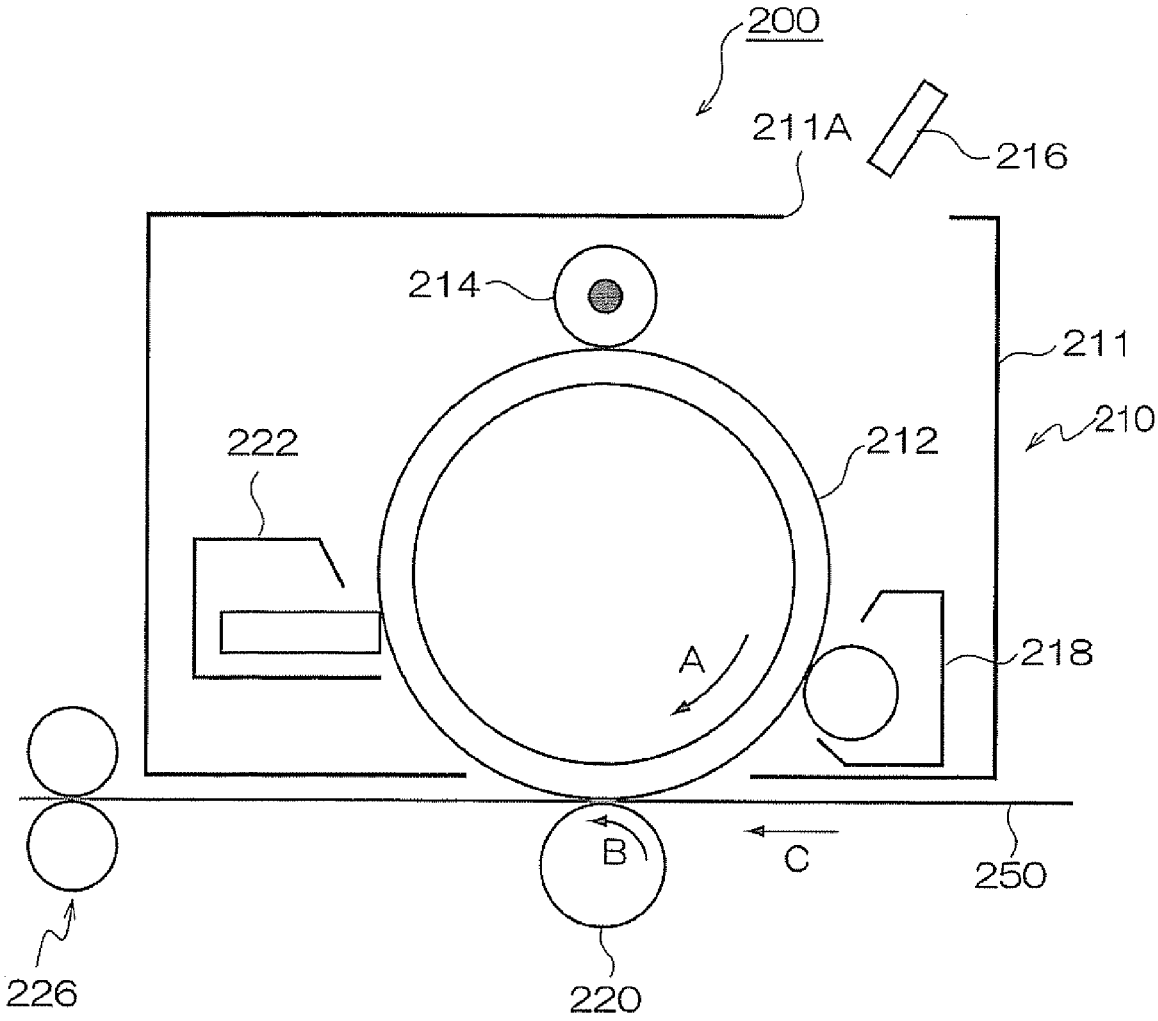
FIG. 2 is a schematic diagram illustrating an example of a process cartridge according to an exemplary embodiment of the present invention.

The image forming apparatus shown in FIG. 2 is an image forming apparatus having such a configuration that the cartridge 28 is attached thereto and detached therefrom. In the image forming apparatus shown in FIG. 2, the cartridge 28 is connected to the developing section 18 via a developer supply tube 30. Upon image forming, the developer of the invention accommodated in the cartridge 28 is supplied to the developing section 18 through the developer supply tube 30, so that image formation with the developer may be performed over a long time. When the developer accommodated in the cartridge 28 becomes scarce, the cartridge 28 can be replaced.

Around the electrostatic latent image holder 12, the charging section 14 that charges a surface of the electrostatic latent image holder 12, the electrostatic latent image forming section 16 that forms an electrostatic latent image on the surface of the electrostatic latent image holder in accordance with image information, the developing section 18 that supplies the developer of the present invention to the thus formed electrostatic latent image, the drum-shaped transfer section 20 that contacts the surface of the electrostatic latent image holder 12 and can be rotated in the direction indicated by the arrow B by the rotation of the electrostatic latent image holder 12 in the direction indicated by an arrow A, a cleaning section 22 that contacts the surface of the electrostatic latent image holder 12, and the neutralization section 24 that removes electricity from the surface of the electrostatic latent image holder 12, are provided in this order along the rotation direction (direction indicated by the arrow A) of the electrostatic latent image holder 12.

The recording medium 50 that is transferred in the direction indicated by the arrow C from the upstream side by a transfer section not shown in the figure can pass through between the electrostatic latent image holder 12 and the transfer section 20. At the downstream side (with respect to the direction indicated by arrow C) of the electrostatic latent image holder 12, a fixing section 26 having a built-in heating source (not shown in the figure) is disposed, and the fixing section 26 has a contact portion 32. The recording medium 50 that has passed through between the electrostatic latent image holder 12 and the transfer section 20 can pass through this contact portion 32 in the direction indicated by the arrow C.

As the electrostatic latent image holder 12, a photoreceptor, a dielectric recording medium, or the like may be used, for example. As the photoreceptor, a photoreceptor having a single layer structure, a photoreceptor having a multi-layer structure, or the like may be used. The material of the photoreceptor may be an inorganic photosensitive material such as selenium or amorphous silicon, an organic photosensitive material, or the like.

Examples of the charging section 14 include known devices such as a contact charging apparatus using an electrical conductive or semiconductive roller, brush, film, rubber blade, or the like, and a non-contact charging apparatus such as a corotron or scorotron charger using corona discharge.

Examples of the electrostatic latent image forming section 16 include light exposing devices and any other known devices that can generate a signal that forms a toner image at a predetermined position on a recording medium surface.

Examples of the light exposing devices include known light exposing devices such as a combination of a semiconductor laser and a scanning device, a laser scan-writing device composed of an optical system, and an LED head. The laser scan-writing, device or the LED head may be used in view of realizing a preferred embodiment in which a uniform exposure image having a high dissolution is formed.

Specific examples of the transfer section 20 include known devices, such as a device that generates an electric field between the electrostatic latent image holder 12 and the recording medium 50 by using an electrical conductive or semiconductive roller, brush, film, rubber blade, or the like to which an voltage is applied so as to transfer a toner image formed by charged toner particles; and a device that corona-charges the rear face of the recording medium 50 with a corotron or scorotron charger using corona discharge so as to transfer a toner image formed by charged toner particles.

In addition, the transfer section 20 may involve a secondary transfer section. Namely, the secondary transfer section, not shown in the figure, receives a toner image and temporarily holds the toner image, and then performs secondary transfer of the toner image therefrom to the recoding medium 50.

Examples of the cleaning section 22 include a cleaning blade and a cleaning brush. In the exemplary embodiment, a blade cleaning member using a cleaning blade is used as the cleaning section 22.

Examples of the neutralization section 24 include a tungsten lamp and an LED.

The fixing section 26 may be a known contact-type thermal fixing apparatus, for example.

Specific examples thereof include a heat roll fixing apparatus that include: (i) a heating roll having a rubber elastic layer on a core metal bar and optionally having a fixing member surface layer and (ii) a pressure roll having a rubber elastic layer on a core metal bar and optionally having a fixing member surface layer; and a fixing apparatus that has a combination of a roll and a belt or a combination of a belt and a belt in place of the combination of a roll and a roll in the heat roll fixing apparatus.

Next, image formation using the image forming apparatus 10 is described. First, as the electrostatic latent image holder 12 rotates in the direction indicated by the arrow A, a surface of the electrostatic latent image holder 12 is charged with the charging section 14, an electrostatic latent image in accordance with image information is formed on the surface of the charged electrostatic latent image holder 12 by the electrostatic latent image forming section 16, and a toner image is formed by supplying, in accordance with the color information of the electrostatic latent image, the developer of the present invention from the developing section 18 to the surface of the electrostatic latent image holder 12 on which the electrostatic latent image has been formed.

Subsequently, the toner image which has been formed on the surface of the electrostatic latent image holder 12 is moved to a contact portion between the electrostatic latent image holder 12 and the transfer section 20, according to the rotation of the electrostatic latent image holder 12 in the direction indicated by the arrow A. At this time, the recording medium 50 is passed through the contact portion in the direction indicated by the arrow C by a sheet conveying roll (not shown in the figure), and the toner image that has been formed on the surface of the electrostatic latent image holder 12 is transferred to a surface of the recording medium 50 at the contact portion by an voltage applied between the electrostatic latent image holder 12 and the transfer section 20.

After the toner image is transferred by the transfer section 20, remaining toner is removed from the surface of the electrostatic latent image holder by the cleaning blade of the cleaning section 22, and electricity is removed from the surface by the neutralization section 24.

The recording medium 50 having the surface on which the toner image has been transferred in this way is conveyed to the contact portion 32 of the fixing section 26. When the recording medium 50 passes through the contact portion 32, the recording medium 50 is heated by the fixing section 26 that has the contact portion 32 whose surface is heated by the built-in heating source (not shown in the figure). Through this process, the toner image is fixed to the surface of the recording medium 50.

FIG. 2 is a cross-sectional view schematically illustrating the basic configuration of an image forming apparatus in another exemplary embodiment. The image forming apparatus shown in FIG. 2 has a configuration having a process cartridge.

The image forming apparatus shown in FIG. 2 has a process cartridge 210 that is installed detachably in a main body (not shown in the figure) of the image forming apparatus, an electrostatic latent image forming section 216, a transfer section 220, and a fixing section 226.

The process cartridge 210 has a electrostatic latent image holder 212 and a charging section 214, a developing section 218, and a cleaning section 222 that are disposed around the electrostatic latent image holder 212. The electrostatic latent image holder 212, the charging section 214, the developing section 218, and the cleaning section 222 are integrated by using a fixing rail (now shown in the figure), and are disposed in a housing 211 having an opening 211A for forming an electrostatic latent image. It should be noted that the process cartridge 210 is not limited to the above, other configurations may be adopted as long as the process cartridge has a developing section 218 and at least one of the electrostatic latent image holder 212, the charging section 214, or the cleaning section 222.

The electrostatic latent image forming section 216 is arranged at such a position that the electrostatic latent image forming section 216 can form an electrostatic latent image on the electrostatic latent image holder 212 through the opening 211A of the housing 211 of the process cartridge 210. The transfer section 220 is arranged at such a position that the transfer section 220 faces the electrostatic latent image holder 212.

Details of the electrostatic latent image holder 212, the charging section 214, the electrostatic latent image forming section 216, the developing section 218, the transfer section 220, the cleaning section 222, the fixing section 226, and the recording medium 250 are similar to those of the electrostatic latent image holder 12, the charging section 14, the electrostatic latent image forming section 16, the developing section 18, the transfer section 20, the cleaning section 22, the fixing section 26, and the recording medium 50, respectively, in the image forming apparatus 10 shown in FIG. 1. The meanings of the arrows A and C are also similar to those of the arrows A and C in FIG. 1, respectively.

Further, image formation using the image forming apparatus 200 of FIG. 2 is also similar to the image formation using the image forming apparatus 10 of FIG. 1.

EXAMPLES

Hereinafter, the present invention will be further described with reference to the following examples. However, the examples should not be construed as limiting the present invention. It should be noted that, in the examples, "part(s)" and "%" denote "part(s) by weight" and "% by weight" respectively, unless specified otherwise.

The measurement methods used in the examples are described first.

(1) Molecular Weight Measurement

The molecular weight distribution is measured under the following conditions. HLC-8120 GPC, SC8020 apparatus manufactured by TOSOH Corp. is used with TSK gel Super HM-H (6.0 mm ID×15 cm×2) column and THF as an eluent. Experimental conditions are as follows: sample concentration is 0.5%, flow rate is 0.6 ml/min, sample injection amount is 10 μl, measurement temperature is 40° C., and calibration curves are prepared from 10 samples of A-500, F-1, F-10, F-80, F-380, A-2500, F-4, F-40, F-128, and F-700. The data sampling interval in the sample analysis is selected to be 300 msec.

(2) Toner Particle Diameter Measurement

Toner particle diameter and particle diameter distribution are measured with COULTER COUNTER MULTISIZER-II (manufactured by BECKMAN COULTER Corp.) using an electrolyte—ISOTON-II (manufactured by BECKMAN COULTER Corp.).

Upon measurement, a measurement sample in an amount of from 0.5 mg to 50 mg is added to 2 ml of a 5 weight % aqueous solution of sodium alkylbenzene sulfonate as a dispersant, and then the resultant mixture is added to 100 ml to 150 ml of the electrolyte described above. The electrolyte in which the sample is suspended is subjected to dispersing treatment with a ultrasonic disperser for about 1 minute. Particle diameter distribution for the particles of from 2 μm to 60 μm is measured with an aperture having a diameter of 100 μm, and a volume average particle diameter D50 v is evaluated as described above. The number of the particles measured is 50,000.

(3) Volume Average Particle Diameter of Resin Fine Particles, Coloring Agent Particles, and Others Measurements are performed with a laser diffraction/scattering particle diameter distribution analyzer (LS Particle Diameter Analyzer: LS13 320, manufactured by BECKMAN COULTER Corp.). A volume cumulative distribution curve is drawn from the small diameter side based on the obtained particle diameter distribution determined from the counts for the respective divided particle diameter ranges (channels), and a diameter at which the cumulative volume reaches 50% of the total volume is used as the volume average particle diameter d.

(4) Melting Temperature and Glass Transition Temperature

An amount of absorbed heat is measured with a differential scanning calorimeter (DSC 60, manufacture by Shimadzu Corp., equipped with an automatic tangential line analysis system) in accordance with ASTMD3418-8 (which is incorporated herein by reference) from room temperature to 150° C. at a temperature elevation speed of 10° C./min. The glass transition temperature of the non-crystalline polyester resin and the melting temperature of the crystalline polyester resin are obtained from the respective maximum peaks in the heat absorption measurement.

It should be noted that the temperature at which a line extended from the base line and a line extended from the ascending line in an endothermic change is used as the glass transition temperature. The temperature at an endothermic peak is used as the melting temperature.

Toner Preparation

Preparation of Non-Crystalline Polyester Resin Dispersion Liquids (1) to (8)

In a reactor equipped with a stirrer, a thermometer, a condenser, and a nitrogen gas inlet tube, the respective materials are charged in the material composition ratios (parts) shown in Table 1. After the inside of the reactor is replaced by dry nitrogen gas, a catalyst shown in Table 1 is added. The resultant reaction mixture is stirred at about 195° C. for about 6 hours in a nitrogen gas stream, and further stirred and reacted for about 6.0 hours after the temperature was elevated to about 240° C. Thereafter, the pressure inside of the reactor is reduced to 10.0 mmHg, and the reaction mixture is still further stirred and reacted for about 0.5 hour under reduced pressure to obtain pale yellow to yellow transparent non-crystalline polyester resins (1) to (8).

TABLE 1

| | Non-crystalline polyester resin (1) | Non-crystalline polyester resin (2) | Non-crystalline polyester resin (3) | Non-crystalline polyester resin (4) | Non-crystalline polyester resin (5) | Non-crystalline polyester resin (6) | Non-crystalline polyester resin (7) | Non-crystalline polyester resin (8) |
|---|---|---|---|---|---|---|---|---|
| Dimethyl terephthalate | 120 | 100 | 120 | 120 | 90 | 120 | 100 | 80 |
| Dimethyl fumarate | 0 | 60 | 0 | 0 | 45 | 60 | 60 | 60 |
| Dodecenyl succinic anhydride | 90 | 0 | 50 | 0 | 50 | 0 | 30 | 0 |
| n-Octenyl succinic anhydride | 0 | 0 | 0 | 75 | 0 | 0 | 0 | 40 |
| Anhydrous trimellitic acid | 10 | 20 | 10 | 10 | 0 | 0 | 0 | 0 |
| Bisphenol A ethylene oxide 2 mol adduct | 120 | 270 | 80 | 160 | 50 | 110 | 95 | 65 |
| Bisphenol A propylene oxide 2 mol adduct | 205 | 50 | 260 | 170 | 290 | 220 | 240 | 270 |
| Dibutyl tin oxide | 2.5 | 2.5 | 2.5 | 2.5 | 2.5 | 2.5 | 2.5 | 2.5 |

Thereafter, the resultant non-crystalline polyester resins (1) to (8) are dispersed with a high-pressure high-temperature disperser remodeled from "CAVITRON CD101" (trade name) manufactured by Eurotec, Ltd. The CAVITRON is operated at a composition ratio of 80% of ion-exchange water and 20% of the polyester resin, with the pH being adjusted to 8.5 with ammonia, and under the conditions of a rotor revolution of 60 Hz, a pressure of 5 $Kg/Cm^2$, and a temperature of 140° C. by heating with a heat exchanger; as a result, non-crystalline polyester resin dispersion liquids (1) to (8) (solid content: 20%) are obtained respectively.

The weight average molecular weight and glass transition temperature of the resultant non-crystalline polyester resins (1) to (8) and the volume average particle diameter of the dispersed particles of the non-crystalline polyester resins (1) to (8) are shown in Table 2

TABLE 2

| | Non-crystalline polyester resin (1) | Non-crystalline polyester resin (2) | Non-crystalline polyester resin (3) | Non-crystalline polyester resin (4) | Non-crystalline polyester resin (5) | Non-crystalline polyester resin (6) | Non-crystalline polyester resin (7) | Non-crystalline polyester resin (8) |
|---|---|---|---|---|---|---|---|---|
| Weight average molecular weight | 110,000 | 125,000 | 98,000 | 132,000 | 22,000 | 17,000 | 23,000 | 24,000 |
| Glass transition temperature | 56.3° C. | 61.0° C. | 58.2° C. | 57.1° C. | 60.5° C. | 63.2° C. | 61.3° C. | 59.8° C. |
| Volume average particle diameter of dispersed particles | 172 nm | 188 nm | 166 nm | 189 nm | 158 nm | 149 nm | 179 nm | 166 nm |

Preparation of Crystalline Polyester Resin Dispersion Liquids (a) to (c)

In a flask, materials are mixed in material composition ratios (part) shown in Table 3. The resultant reaction mixture is heated to 220° C. and subjected to a dehydration condensation reaction under a reduced pressure for 6 hours so as to obtain crystalline polyester resins (a) to (c). After that, 80 parts of each of the crystalline polyester resins (a) to (c) and 720 parts of deionized water are charged in a stainless beaker, which is then put in a hot bath and heated to 98° C. When the crystalline resin is fused, stirring of the resin is with a homogenizer ("ULTRA-TURRAX" (trade name) T50, manufactured by IKA Company) at 7,000 rpm is started. Then, the resin is emulsified while 1.8 parts of an anionic surfactant ("NEOGEN RK" (trade name), manufactured by DAI-ICHI KOGYO SEIYAKU CO., LTD.; 20% by weight) is dropped, so that crystalline polyester resin dispersion liquids (a) to (c) (solid content: 10%) are obtained.

TABLE 3

| | Crystalline polyester resin (a) | Crystalline polyester resin (b) | Crystalline polyester resin (c) |
|---|---|---|---|
| Dimethyl dodecanedioate | 130 | 0 | 0 |
| Dimethyl sebacate | 0 | 120 | 0 |
| Dimethyl terephthalate | 0 | 0 | 100 |
| 1,9-Nonane diol | 80 | 0 | 80 |

TABLE 3-continued

| | Crystalline polyester resin (a) | Crystalline polyester resin (b) | Crystalline polyester resin (c) |
|---|---|---|---|
| 1,6-Hexane diol | 0 | 60 | 0 |
| Titanium tetrabutoxide | 2 | 2 | 2 |

The melting temperatures of the obtained crystalline polyester resins (a) to (c) and the volume average particle diameters of the dispersed particles of the crystalline polyester resins (a) to (c) are shown in Table 4.

TABLE 4

| | Crystalline polyester resin (a) | Crystalline polyester resin (b) | Crystalline polyester resin (c) |
|---|---|---|---|
| Weight average molecular weight | 24,000 | 22,000 | 18,000 |
| Melting temperature | 73° C. | 70° C. | 91° C. |
| Volume average particle diameter of dispersed particles | 175 nm | 158 nm | 199 nm |

Preparation of Releasing Agent Dispersion Liquid

Paraffin wax HNP9 (melting temperature: 74° C., manufactured by Nippon Seiro Co., Ltd.): 45 parts, Anionic surfactant ("NEOGEN RK" (trade name), manufactured by DAI-ICHI KOGYO SEIYAKU CO., LTD.): 5 parts, and Ion-exchange water: 200 parts.

The above components are heated to 95° C. and dispersed with a homogenizer ("ULTRA-TURRAX" (trade name) T50, manufactured by IKA Company), and further dispersed with a pressure discharge type gaulin homogenizer (manufactured by APV GAULIN, INC.) to prepare a releasing agent dispersion liquid (a) (having a releasing agent concentration of 20%) in which a releasing agent having a volume average particle diameter of 210 nm is dispersed.

Preparation of Coloring Agent Dispersion Liquid

Cyan pigment (Pigment Blue 15:3 (copper phthalocyanine), manufactured by Dainichiseika Color & Chemicals Mfg. Co., Ltd.): 1,000 parts, Anionic surfactant ("NEOGEN R" (trade name), manufactured by DAI-ICHI KOGYO SEIYAKU CO., LTD.): 150 parts, and Ion-exchange water: 9,000 parts.

The above components are mixed, dissolved, and dispersed for about 1 hour with a high-pressure impact type disperser ultimizer (HJP30006, manufactured by Sugino Machine Ltd.) to obtain a coloring agent dispersion liquid in which a coloring agent (cyan pigment) is dispersed. The volume average particle diameter of the coloring agent (cyan pigment) in the coloring agent dispersion liquid is 0.15 μm, and the coloring agent particle concentration is 23%.

weight sodium hydroxide aqueous solution. Then, while the pH is adjusted to 8.0 after temperature elevation of every 5° C., the temperature is elevated to 90° C. at a rate of 1° C./min. and kept at 90° C. The shape and surface property of the particles are observed under an optical microscope and a scanning electron microscope (FE-SEM) every 30 minutes. After the aggregated particles are sufficiently fused, the reaction solution is cooled with ice water so as to fix the particle state.

After that, the reaction product is collected by filtration, sufficiently washed with ion-exchange water, dried with a vacuum drier to obtain toners A to F. The volume average particle diameter of the resultant toners is shown in Table 6.

TABLE 5

| | | Toner A | Toner B | Toner C | Toner D | Toner E | Toner F |
|---|---|---|---|---|---|---|---|
| Dispersion liquid stirred and mixed | Non-crystalline polyester resin dispersion liquid | Non-crystalline polyester resin dispersion liquid (1) 110 parts Non-crystalline polyester resin dispersion liquid (4) 110 parts | Non-crystalline polyester resin dispersion liquid (3) 220 parts | Non-crystalline polyester resin dispersion liquid (1) 110 parts Non-crystalline polyester resin dispersion liquid (7) 110 parts | Non-crystalline polyester resin dispersion liquid (4) 110 parts Non-crystalline polyester resin dispersion liquid (8) 110 parts | Non-crystalline polyester resin dispersion liquid (2) 110 parts Non-crystalline polyester resin dispersion liquid (6) 110 parts | Non-crystalline polyester resin dispersion liquid (1) 110 parts Non-crystalline polyester resin dispersion liquid (7) 110 parts |
| | Crystalline polyester resin dispersion liquid | Crystalline polyester resin dispersion liquid (a) 100 parts | Crystalline polyester resin dispersion liquid (a) 100 parts | Crystalline polyester resin dispersion liquid (b) 100 parts | Crystalline polyester resin dispersion liquid (b) 100 parts | Crystalline polyester resin dispersion liquid (a) 100 parts | Crystalline polyester resin dispersion liquid (c) 100 parts |
| | Releasing agent dispersion liquid | 50 parts | 50 parts | 50 parts | 50 parts | 50 parts | 50 parts |
| | Pigment dispersion liquid | 26 parts | 26 parts | 26 parts | 26 parts | 26 parts | 26 parts |
| Additional dispersion liquid | Non-crystalline polyester resin dispersion liquid | Non-crystalline polyester resin dispersion liquid (1) 75 parts Non-crystalline polyester resin dispersion liquid (4) 75 parts | Non-crystalline polyester resin dispersion liquid (3) 150 parts | Non-crystalline polyester resin dispersion liquid (1) 75 parts Non-crystalline polyester resin dispersion liquid (7) 75 parts | Non-crystalline polyester resin dispersion liquid (4) 75 parts Non-crystalline polyester resin dispersion liquid (8) 75 parts | Non-crystalline polyester resin dispersion liquid (2) 75 parts Non-crystalline polyester resin dispersion liquid (6) 75 parts | Non-crystalline polyester resin dispersion liquid (1) 75 parts Non-crystalline polyester resin dispersion liquid (7) 75 parts |

Preparation of Toners A to F

In a round-bottom stainless flask, materials shown in Table 5 (the dispersion liquid described in the column of "Dispersion liquid stirred and mixed" in Table 5) are charged, and sufficiently mixed and dispersed with a homogenizer ("ULTRA-TURRAX" (trade name) T50, manufactured by IKA Company). After that, a 1% aqueous solution of aluminum sulfate as a flocculant is added to the resultant dispersion liquid, and the dispersing operation is continued with ULTRA-TURRAX.

A stirrer and a mantle heater are set up. While the rotation number of the stirrer is adjusted such that the slurry is sufficiently agitated, the temperature is elevated to 40° C. at a rate of 0.5° C./min and kept at 40° C. for 15 minutes, and then the temperature is further elevated at a rate of 0.05° C./min during which the particle diameter is measured every 10 minutes with COULTER MULTICIZER II (aperture diameter: 100 μm, manufactured by COULTER Corp.). When the volume average particle diameter became 5.2 μm, a non-crystalline polyester resin dispersion liquid (the dispersion liquid described in the column of "Additional dispersion liquid" in Table 5) as an additional resin is added over 3 minutes. After the addition, the dispersion liquid is left at that state for 30 minutes, and then the pH is adjusted to 8.0 with a 5% by

TABLE 6

| | Toner A | Toner B | Toner C | Toner D | Toner E | Toner F |
|---|---|---|---|---|---|---|
| Volume average particle diameter | 5.9 μm | 6.1 μm | 6.2 μm | 6.0 μm | 5.6 μm | 6.0 μm |

To 100 parts of each of the resultant toners A to F, 1 part of hydrophobic silica particles (RY-50, manufactured by Nippon Aerosil Co., Ltd.), and 0.8 part of hydrophobic titanium oxide particles are added. The mixture is treated with a Henschel mixer so as to perform external addition.

Preparation of Carrier

Production of Resin Serving as a Material of Resin Coating Layer

Production of Resin A

Resin A is produced as follows.

Cyclohexyl methacrylate (CHMA): 1,500 parts (90 mol %),

Dimethylaminoethyl methacrylate (DMAEMA): 8 parts (0.5 mol %),

Methyl methacrylate (MMA): 100 parts (9.5 mol %),

Benzene: 1,600 parts, and

Azobisisobutylonitrile (AIBN): 8 parts.

The above components are mixed, heated to 60° C., and shaken for 8 hours, so as to perform polymerization. The resultant reaction mixture is dissolved in methyl ethyl ketone, and re-precipitated with a ten-fold amount of hexane so as to obtain resin A. The weight average molecular weight of resin A is 110,000.

Production of Resin B

Cyclohexyl methacrylate (CHMA): 1,500 parts (88 mol %),

Dimethylaminoethyl methacrylate (DMAEMA): 30 parts (2.0 mol %), n-Butyl methacrylate (nBMA): 140 parts (10 mol %), Benzene: 1,600 parts, and Azobisisobutylonitrile (AIBN): 8 parts.

The above components are reacted similarly to the production of resin A, so that resin B is obtained. The weight average molecular weight of resin B is 96,000.

Production of Resin C

Cyclohexyl methacrylate (CHMA): 1,000 parts (60 mol %),

Methyl methacrylate (MMA): 440 parts (40 mol %),

Benzene: 1,600 parts, and

Azobisisobutylonitrile (AIBN): 7 parts.

The above components are reacted similarly to the production of resin A, so that resin C is obtained. The weight average molecular weight of resin C is 130,000.

Production of Resin D

Cyclohexyl methacrylate (CHMA): 1,500 parts (90 mol %),

Dimethylaminioethyl methacrylate (DMAEMA): 95 parts (6 mol %),

Methyl methacrylate (MMA): 45 parts (4 mol %),

Benzene: 1,600 parts, and

Azobisisobutylonitrile (AIBN): 8 parts.

The above components are reacted similarly to the production of resin A, so that resin D is obtained. The weight average molecular weight of resin D is 103,000.

Production of Resin E

Methyl methacrylate (MMA): 460 parts (42 mol %), n-Butyl methacrylate (n-BMA): 640 parts (45 mol %), Dimethylaminoethyl methacrylate (DMAEMA): 50 parts (3 mol %)

Azobisisobutylonitrile (AIBN): 7 parts, and

Benzene: 1,600 parts.

The above components are reacted similarly to the production of resin A, so that resin E is obtained. The weight average molecular weight of resin E is 150,000.

Preparation of Carrier A

Mn—Mg—Sr ferrite particles (EF-35B, with a volume average particle diameter of 35 μm, manufactured by Powdertech Co., Ltd.): 1,000 parts, Toluene: 100 parts.

Resin A: 25 parts, and

Carbon black (VXC-72, manufactured by CABOT Corp.): 2.6 parts.

Among the above materials, resin A is diluted in toluene, and then carbon black is added thereto. The resultant mixture is agitated for 5 minutes with a homogenizer to obtain a resin solution. The resin solution and the magnetic particles A are charged in a vacuum kneader and are agitated at 90° C. for 20 minutes. After that, toluene is removed under reduced pressure and the resultant product is cooled under stirring until the temperature of the product became 60° C. The resultant coated carrier is taken out and sieved with a 75 μm mesh screen to obtain carrier A.

Preparation of Carrier B

Mn—Mg—Sr ferrite particles (EF-35B, with a volume average particle diameter of 35 μm, manufactured by Powdertech Co., Ltd.): 1,000 parts, Toluene: 100 parts, Resin B: 25 parts, and Carbon black (VXC-72, manufactured by CABOT Corp.): 2.6 parts.

Carrier B is obtained in the same manner as to the production of carrier A, except that resin A used in the preparation of carrier A is replaced by resin B.

Preparation of Carrier C

Mn—Mg—Sr ferrite particles (EF-35B, with a volume average particle diameter of 35 μm, manufactured by Powdertech Co., Ltd.): 1,000 parts, Toluene: 100 parts, Resin C: 25 parts, and Carbon black (VXC-72, manufactured by CABOT Corp.): 2.6 parts.

Carrier C is obtained in the same manner as the production of carrier A, except that resin A used in the preparation of carrier A is replaced by resin C.

Preparation of Carrier D

Mn—Mg—Sr ferrite particles (EF-35B, with a volume average particle diameter of 35 μm, manufactured by Powdertech Co., Ltd.): 1,000 parts, Toluene: 100 parts, Resin D: 25 parts, and Carbon black (VXC-72, manufactured by CABOT Corp.): 2.6 parts.

Carrier D is obtained in the same manner as the production of carrier A, except that resin A used in the preparation of carrier A is replaced by resin D.

Preparation of Carrier E

Mn—Mg—Sr ferrite particles (EF-35B, with a volume average particle diameter of 35 μm, manufactured by Powdertech Co., Ltd.): 1,000 parts, Toluene: 100 parts, Resin E: 25 parts, and Carbon black (VXC-72, manufactured by CABOT Corp.): 2.6 parts.

Carrier D is obtained in the same manner as the production of carrier A, except that resin A used in the preparation of carrier A is replaced by resin E.

Production of Developer A

Thus prepared electrophotographic toner A in an amount of 8 parts and carrier A in an amount of 92 parts are charged in a V-type blender and mixed for 20 minutes at 40 rpm to obtain developer A.

Production of Developer B

Developer B is obtained in the same manner as the production of developer A, except that toner A is replaced by toner B and carrier A is replaced by carrier B.

Production of Developer C

Developer C is obtained in the same manner as the production of developer A, except that toner A is replaced by toner C and carrier A is replaced by carrier D.

Production of Developer D

Developer D is obtained in the same manner as the production of developer A, except that toner A is replaced by toner C and carrier A is replaced by carrier B.

Production of Developer E

Developer E is obtained in the same manner as to the production of developer A, except that toner A is replaced by toner D.

Production of Developer F

Developer F is obtained in the same manner as the production of developer A, except that carrier A is replaced by carrier C.

Production of Developer G

Developer G is obtained in the same manner as the production of developer A, except that toner A is replaced by toner E.

Production of Developer H

Developer H is obtained in the same manner as the production of developer A, except that toner A is replaced by toner F and carrier A is replaced by carrier D.

Production of Developer I

Developer I is obtained in the same manner as the production of developer A, except that toner A is replaced by toner B and carrier A is replaced by carrier E.

Examples 1 to 5 and Comparative Examples 1 to 4

As shown in Table 7, each of the foregoing developers A to I is evaluated using a copy machine remodeled from a color copier, "DocuCentre-II C7500", manufactured by Fuji Xerox Co. Ltd. Remodeling is made in a manner that the copy machine can be operated even when a developer is loaded on only one of the developing devices; further, the circumferential velocity of the developer holder is made changeable to 200 mm/sec, 300 mm/sec, and 750 mm/sec; and the circumferential velocity of the electrostatic latent image holder is made changeable in the range of from 150 mm/sec to 500 mm/sec. The surface roughness Rz of the developer holder used is 20 μm.

Upon evaluation, after the developer is loaded, printing is continuously performed on 10,000 sheets in a high temperature and high humidity environment (32° C. and 90% RH). The printed image used is an image in the shape of a band extending along the entire width of the sheet, which is orthogonal to the processing direction. The image has an image density of 2%, and is printed at 50 mm from the leading end of the page. After printing on 10,000 sheets, a whole-surface halftone image having an image density of 20% is printed, and the presence or absence of image defects (including concentration irregularity, black dots, and white dots) on the whole-surface halftone image are checked, and evaluation is conducted according to the following criteria (as image quality after printing on 10,000 sheets). In addition, the developer is taken out of the developing device, and sticking condition of the toner to the developer holder surface, developer layer forming member, and inside of the developing apparatus is checked respectively by visual observation, and evaluation is conducted according to the following criteria. The results are shown in Table 7.

Evaluation Criteria

Image quality after printing on 10,000 sheets:

A: There is no problems,

B: Minor irregularities are observed, which are acceptable,

C: There are at least one of black dots, white dots, concentration irregularity, or the like, which is not acceptable, and D: One or more of black dots, white dots, concentration irregularity, or the like are remarkable, which are not acceptable.

Sticking Condition:

A: Sticking is not observed,

B: Minor sticking is observed, which is acceptable,

C: Moderate sticking is observed, which is not acceptable, and

D: Heavy sticking is observed, which is not acceptable.

TABLE 7

| | | | | | Evaluation results | | | |
|---|---|---|---|---|---|---|---|---|
| | Developer | Toner | Carrier | Circumferential velocity of developer holder (circumferential velocity ratio) | Image qualities after printing on 10,000 sheets | Contamination (Sticking) on developer holder surface | Sticking on developer layer forming member | Sticking inside of developing apparatus |
| Example 1 | Developer A | Toner A | Carrier A | 200 mm/sec (1.333) | A | A | A | A |
| | | | | 300 mm/sec (1.500) | A | A | A | A |
| | | | | 750 mm/sec (1.667) | A | B | B | A |
| Example 2 | Developer B | Toner B | Carrier B | 200 mm/sec (1.333) | A | A | A | A |
| | | | | 300 mm/sec (1.500) | A | B | B | A |
| | | | | 750 mm/sec (1.667) | B | B | B | A |
| Example 3 | Developer C | Toner C | Carrier D | 200 mm/sec (1.333) | A | A | A | A |
| | | | | 300 mm/sec (1.500) | B | B | B | A |
| | | | | 750 mm/sec (1.667) | B | B | B | A |
| Example 4 | Developer D | Toner C | Carrier B | 200 mm/sec (1.333) | A | A | A | A |
| | | | | 300 mm/sec (1.500) | A | A | A | A |
| | | | | 750 mm/sec (1.667) | B | B | B | B |
| Example 5 | Developer E | Toner D | Carrier A | 200 mm/sec (1.333) | A | A | A | A |
| | | | | 300 mm/sec (1.500) | A | B | A | A |
| | | | | 750 mm/sec (1.667) | A | B | B | A |
| Comparative Example 1 | Developer F | Toner A | Carrier C | 200 mm/sec (1.333) | A | A | B | A |
| | | | | 300 mm/sec (1.500) | C | B | B | A |
| | | | | 750 mm/sec (1.667) | D | C | C | B |
| Comparative Example 2 | Developer G | Toner E | Carrier A | 200 mm/sec (1.333) | C | B | C | B |
| | | | | 300 mm/sec (1.500) | C | D | D | B |
| | | | | 750 mm/sec (1.667) | D | D | D | D |
| Comparative Example 3 | Developer H | Toner F | Carrier D | 200 mm/sec (1.333) | B | B | B | B |
| | | | | 300 mm/sec (1.500) | C | B | C | B |
| | | | | 750 mm/sec (1.667) | C | C | D | C |
| Comparative Example 4 | Developer I | Toner B | Carrier E | 200 mm/sec (1.333) | C | B | C | B |
| | | | | 300 mm/sec (1.500) | D | C | C | D |
| | | | | 750 mm/sec (1.667) | D | D | D | D |

The invention claimed is:

1. An electrostatic charge developer comprising:

a carrier having a core material and a resin coating layer covering a surface of the core material, the resin coating layer containing a copolymer that contains (i) a nitrogen-containing acrylic ester or a nitrogen-containing methacrylic ester and (ii) an alicyclic acrylic ester or alicyclic methacrylic ester; and a toner containing a binder resin that contains a non-crystalline polyester resin and a crystalline polyester resin, the non-crystalline polyester resin containing at least (i) an alkyl succinic acid or an anhydride or lower alkyl ester thereof or (ii) an alkenyl succinic acid or an anhydride or lower alkyl ester thereof, and the crystalline polyester resin being an aliphatic polyester resin, wherein the content of the nitrogen-containing acrylic ester or nitrogen-containing methacrylic ester in the copolymer is from about 0.2 mol % to about 5 mol %, and the content of the alicyclic acrylic ester or alicyclic methacrylic ester in the copolymer is from about 85 mol % to about 99.8 mol %.

2. The electrostatic charge developer according to claim 1, wherein the crystalline polyester resin is a crystalline polyester resin that is obtained by reacting a dicarboxylic acid having from 10 to 12 carbon atoms and a diol having from 4 to 9 carbon atoms.

3. The electrostatic charge developer according to claim 1, wherein the non-crystalline polyester resin comprises a non-linear polyester resin that contains at least one of a tri- or higher-valent carboxylic acid, an anhydride thereof, or a tri- or higher-hydric alcohol, and a linear polyester resin that does not contain any of a tri- or higher-valent carboxylic acid, an anhydride thereof, or a tri- or higher-hydric alcohol.

4. The electrostatic charge developer according to claim 1, wherein the weight average molecular weight Mw of the non-crystalline polyester resin is from about 14000 to about 140000 and the number average molecular weight Mn of the non-crystalline polyester resin is from about 4000 to about 20000.

5. The electrostatic charge developer according to claim 1, wherein the acid value of the non-crystalline polyester resin is from about 5 to about 25 mg KOH/g.

6. The electrostatic charge developer according to claim 1, wherein the non-crystalline polyester resin has a glass transition temperature of from about 50 to about 70° C.

7. The electrostatic charge developer according to claim 1, wherein the weight average molecular weight Mw of the copolymer is from about 50000 to about 120000.

8. The electrostatic charge developer according to claim 1, wherein the nitrogen-containing acrylic ester or nitrogen-containing methacrylic ester is dimethylaminoethyl methacrylate.

9. The electrostatic charge developer according to claim 8, wherein the alicyclic acrylic ester or alicyclic methacrylic ester is cyclohexyl methacrylate, and the non-crystalline polyester resin includes dodecenyl succinic anhydride or n-octenyl succinic anhydride.

10. An electrostatic charge image developer cartridge that is attachable to and detachable from an image forming apparatus and accommodates at least a developer to be supplied to a developing section disposed in the image forming apparatus, the developer being the electrostatic charge developer of claim 1.

11. A process cartridge that is attachable to and detachable from an image forming apparatus, the process cartridge comprising:

a developing section that accommodates the electrostatic charge developer of claim 1 and develops an electrostatic latent image formed on a surface of an electrostatic latent image holder with the electrostatic charge developer into a toner image; and at least one selected from the group consisting of the electrostatic latent image holder, a charging section that charges the electrostatic latent image holder, and a toner removing section that removes toner remaining on the surface of the electrostatic latent image holder.

12. An image forming apparatus comprising:

an electrostatic latent image holder;

a charging section that charges a surface of the electrostatic latent image holder;

an electrostatic latent image forming section that forms an electrostatic latent image on the surface of the electrostatic latent image holder;

a developing section that develops the electrostatic latent image with a developer into a toner image;

a transfer section that transfers the toner image formed on the surface of the electrostatic latent image holder to a surface of a recording medium; and a fixing section that fixes the toner image transferred to the recording medium, the developer being the electrostatic charge developer of claim 1.

13. The image forming apparatus according to claim 12, wherein the circumferential velocity of a developer holder installed inside of the developing section is about 300 mm/sec or more.

* * * * *